US007720230B2

(12) United States Patent
Allamanche et al.

(10) Patent No.: US 7,720,230 B2
(45) Date of Patent: May 18, 2010

(54) INDIVIDUAL CHANNEL SHAPING FOR BCC SCHEMES AND THE LIKE

(75) Inventors: Eric Allamanche, Nuremberg (DE); Sascha Disch, Fürth (DE); Christof Faller, Tägerwilen (CH); Juergen Herre, Buckenhof (DE)

(73) Assignees: Agere Systems, Inc., Allentown, PA (US); Fraunhofer-Gesellschaft zur Forderung der angewandten Forschung e.V., Munich (DE)

( * ) Notice: Subject to any disclaimer, the term of this patent is extended or adjusted under 35 U.S.C. 154(b) by 1517 days.

(21) Appl. No.: 11/006,482

(22) Filed: Dec. 7, 2004

(65) Prior Publication Data

US 2006/0083385 A1 Apr. 20, 2006

Related U.S. Application Data

(60) Provisional application No. 60/620,480, filed on Oct. 20, 2004.

(51) Int. Cl.
*H04R 5/00* (2006.01)

(52) U.S. Cl. ..... 381/22; 381/23; 704/216; 704/500; 704/501

(58) Field of Classification Search ..... 381/22, 381/23, 1, 17, 18; 704/200, 201, 230, 500, 704/501, 211, 216; 369/4, 5
See application file for complete search history.

(56) References Cited

U.S. PATENT DOCUMENTS 4,236,039 A 11/1980 Cooper ..... 381/23
4,815,132 A 3/1989 Minami ..... 381/1

(Continued)

FOREIGN PATENT DOCUMENTS

CN 1295778 5/2001

(Continued)

OTHER PUBLICATIONS

"Binaural Cue Coding: Rendering of Sources Mixed into a Mono Signal" by Christof Faller, Media Signal Processing Research, Agere Systems, Allentown, PA, USA, 2 pages.

(Continued)

*Primary Examiner*—Vivian Chin
*Assistant Examiner*—Jason R Kurr
(74) *Attorney, Agent, or Firm*—Mendelsohn, Drucker & Associates, P.C.; Steve Mendelsohn

(57) ABSTRACT

At an audio encoder, cue codes are generated for one or more audio channels, wherein an envelope cue code is generated by characterizing a temporal envelope in an audio channel. At an audio decoder, E transmitted audio channel(s) are decoded to generate C playback audio channels, where C>E≧1. Received cue codes include an envelope cue code corresponding to a characterized temporal envelope of an audio channel corresponding to the transmitted channel(s). One or more transmitted channel(s) are upmixed to generate one or more upmixed channels. One or more playback channels are synthesized by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope.

46 Claims, 15 Drawing Sheets

U.S. PATENT DOCUMENTS

| | | | | |
|---|---|---|---|---|
| 4,972,484 | A | 11/1990 | Theile et al. | 704/200.1 |
| 5,371,799 | A | 12/1994 | Lowe et al. | 381/25 |
| 5,463,424 | A | 10/1995 | Dressler | 348/485 |
| 5,579,430 | A | 11/1996 | Grill et al. | 395/2.12 |
| 5,677,994 | A | 10/1997 | Miyamori et al. | 704/501 |
| 5,682,461 | A | 10/1997 | Silzle et al. | 395/2.14 |
| 5,701,346 | A * | 12/1997 | Herre et al. | 381/18 |
| 5,706,309 | A | 1/1998 | Eberlein et al. | 375/260 |
| 5,771,295 | A | 6/1998 | Waller, Jr. | 381/18 |
| 5,812,971 | A | 9/1998 | Herre | 704/230 |
| 5,825,776 | A | 10/1998 | Moon | 370/437 |
| 5,860,060 | A | 1/1999 | Li et al. | 704/500 |
| 5,878,080 | A | 3/1999 | Ten Kate | 375/241 |
| 5,889,843 | A | 3/1999 | Singer et al. | 379/202.01 |
| 5,890,125 | A | 3/1999 | Davis et al. | 704/501 |
| 5,912,976 | A | 6/1999 | Klayman et al. | 381/18 |
| 5,946,352 | A | 8/1999 | Rowlands et al. | 375/242 |
| 5,956,674 | A | 9/1999 | Smyth et al. | 704/200.1 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,131,084 | A | 10/2000 | Hardwick | 704/230 |
| 6,205,430 | B1 | 3/2001 | Hui | 704/500 |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,978,236 | B1 * | 12/2005 | Liljeryd et al. | 704/219 |
| 7,116,787 | B2 | 10/2006 | Faller | 381/17 |
| 7,382,886 | B2 * | 6/2008 | Henn et al. | 381/23 |
| 7,451,091 | B2 * | 11/2008 | Chong et al. | 704/500 |
| 7,516,066 | B2 * | 4/2009 | Schuijers et al. | 704/219 |
| 2001/0031054 | A1 | 10/2001 | Grimani | 381/98 |
| 2002/0055796 | A1 | 5/2002 | Katayama et al. | 700/94 |
| 2003/0035553 | A1 | 2/2003 | Baumgarte et al. | 381/94.2 |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 | 11/2003 | Baumgarte et al. | 381/17 |
| 2003/0236583 | A1 | 12/2003 | Baumgarte et al. | 700/94 |
| 2004/0091118 | A1 | 5/2004 | Griesinger | 381/20 |
| 2005/0053242 | A1 | 3/2005 | Henn et al. | 381/22 |
| 2005/0069143 | A1 | 3/2005 | Budnikov et al. | 381/63 |
| 2005/0157883 | A1 | 7/2005 | Herre et al. | 381/17 |
| 2005/0226426 | A1 | 10/2005 | Oomen et al. | 381/23 |
| 2006/0206323 | A1 | 9/2006 | Breebaart | 704/230 |

FOREIGN PATENT DOCUMENTS

| | | | |
|---|---|---|---|
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| RU | 2214048 | C2 | 10/2003 |
| TW | 347623 | | 12/1998 |
| TW | 360859 | | 6/1999 |
| TW | 444511 | | 7/2001 |
| TW | 510144 | | 11/2002 |
| TW | 517223 | | 1/2003 |
| TW | 521261 | | 2/2003 |
| WO | WO 03/090207 | A1 | 10/2003 |
| WO | WO 03/094369 | A2 | 11/2003 |
| WO | WO 2004/008806 | A1 | 1/2004 |
| WO | WO 2004/049309 | A1 | 6/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"HILN- The MPEG-4 Parametric Audio Coding Tools" by Heiko Purnhagen and Nikolaus Meine, University of Hannover, Hannover, Germany, 4 pages.

"Parametric Audio Coding" by Bernd Edler and Heiko Purnhagen, University of Hannover, Hannover, Germany, pp. 1-4.

"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions on Speech and Audio Processing, vol. II, No. 6, Nov. 2003, pp. 520-531.

"Low Complexity Parametric Stereo Coding", by Erik Schuijers et al., Audio Engineering Society 116$^{th}$ Convention Paper 6073, May 8-11, 2004, Berlin, Germany, pp. 1-11.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"Binarual Cue Coding Applied to Stereo and Multi-Channel Audio Compression," by Christof Faller et al., Audio Engineering Society 112$^{th}$ Covention, Munich, Germany, vol. 112, No. 5574, May 10, 2002, pp. 1-9.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"*Final text for DIS 11172-1 (rev. 2): Information Technology—Coding of Moving Pictures and Associated Audio for Digital Storage Media—Part 1*," ISO/IEC JTC 1/SC 29 N 147, Apr. 20, 1992, Section 3: Audio, XP-002083108, 2 pages.

"Advances in Parametric Coding for High-Quality Audio," by Erik Schuijers et al., Audio Engineering Society Convention Paper 5852, 114$^{th}$ Convention, Amsterdam, The Netherlands, Mar. 22-25, 2003, pp. 1-11.

"Advances in Parametric Coding for High-Quality Audio," by E.G.P. Schuijers et al., Proc. 1$^{st}$ IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.

"From Joint Stereo to Spatial Audio Coding—Recent Progress and Standardization," by Jurgen Herre, Proc. of the 7$^{th}$ Int. Conference on Digital Audio Effects (DAFx' 04), Oct. 5-8, 2004, Naples, Italy, XP002367849.

"Parametric Coding of Spatial Audio," by Christof Faller, Proc. of the 7th Int. Conference on Digital Audio Effects (DAFx' 04), Oct. 5-8, 2004, Naples, Itlay, XP002367850.
"MPEG Audio Layer II: A Generic Coding Standard For Two And Multichannel Sound for DVB, DAB and Computer Multimedia," by G. Stoll, International Broadcasting Convention, Sep. 14-18, 1995, Germany, XP006528918, pp. 136-144.
"Multichannel Natural Music Recording Based on Psychoacoutstic Principles", by Gunther Theile, Extended version of the paper presented at the AES 19th International Conference, May 2001, Oct. 2001, pp. 1-45.

* cited by examiner

INDIVIDUAL CHANNEL SHAPING FOR BCC SCHEMES AND THE LIKE

CROSS-REFERENCE TO RELATED APPLICATIONS

This application claims the benefit of the filing date of U.S. provisional application No. 60/620,480, filed on Oct. 20, 2004, the teachings of which are incorporated herein by reference.

In addition, the subject matter of this application is related to the subject matter of the following U.S. applications, the teachings of all of which are incorporated herein by reference:

U.S. application Ser. No. 09/848,877, filed on May 4, 2001;

U.S. application Ser. No. 10/045,458, filed on Nov. 7, 2001, which itself claimed the benefit of the filing date of U.S. provisional application No. 60/311,565, filed on Aug. 10, 2001;

U.S. application Ser. No. 10/155,437, filed on May 24, 2002;

U.S. application Ser. No. 10/246,570, filed on Sep. 18, 2002;

U.S. application Ser. No. 10/815,591, filed on Apr. 01, 2004;

U.S. application Ser. No. 10/936,464, filed on Sep. 08, 2004;

U.S. application Ser. No. 10/762,100, filed on Jan. 20, 2004; and

U.S. application Ser. No. 11/006,492 filed on the same date as this application.

The subject matter of this application is also related to subject matter described in the following papers, the teachings of all of which are incorporated herein by reference:

F. Baumgarte and C. Faller, "Binaural Cue Coding—Part I: Psychoacoustic fundamentals and design principles," *IEEE Trans. on Speech and Audio Proc.*, vol. 11, no. 6, November 2003;

C. Faller and F. Baumgarte, "Binaural Cue Coding—Part II: Schemes and applications," *IEEE Trans. on Speech and Audio Proc.*, vol. 11, no. 6, November 2003; and C. Faller, "Coding of spatial audio compatible with different playback formats," *Preprint* 117$^{th}$ *Conv. Aud. Eng Soc.*, October 2004.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-D *Sound for Virtual Reality and Multimedia*, Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

SUMMARY OF THE INVENTION

According to one embodiment, the present invention is a method, apparatus, and machine-readable medium for encoding audio channels. One or more cue codes are generated and transmitted for one or more audio channels, wherein at least one cue code is an envelope cue code generated by characterizing a temporal envelope in one of the one or more audio channels.

According to another embodiment, the present invention is an apparatus for encoding C input audio channels to generate E transmitted audio channel(s). The apparatus comprises an envelope analyzer, a code estimator, and a downmixer. The envelope analyzer characterizes an input temporal envelope of at least one of the C input channels. The code estimator generates cue codes for two or more of the C input channels.

The downmixer downmixes the C input channels to generate the E transmitted channel(s), where C>E≧1, wherein the apparatus transmits information about the cue codes and the characterized input temporal envelope to enable a decoder to perform synthesis and envelope shaping during decoding of the E transmitted channel(s).

According to another embodiment, the present invention is an encoded audio bitstream generated by encoding audio channels, wherein one or more cue codes are generated for one or more audio channels, wherein at least one cue code is an envelope cue code generated by characterizing a temporal envelope in one of the one or more audio channels. The one or more cue codes and E transmitted audio channel(s) corresponding to the one or more audio channels, where E≧1, are encoded into the encoded audio bitstream.

According to another embodiment, the present invention is an encoded audio bitstream comprising one or more cue codes and E transmitted audio channel(s). The one or more cue codes are generated for one or more audio channels, wherein at least one cue code is an envelope cue code generated by characterizing a temporal envelope in one of the one or more audio channels. The E transmitted audio channel(s) correspond to the one or more audio channels.

According to another embodiment, the present invention is a method, apparatus, and machine-readable medium for decoding E transmitted audio channel(s) to generate C playback audio channels, where C>E≧1. Cue codes corresponding to the E transmitted channel(s) are received, wherein the cue codes comprise an envelope cue code corresponding to a characterized temporal envelope of an audio channel corresponding to the E transmitted channel(s). One or more of the E transmitted channel(s) are upmixed to generate one or more upmixed channels. One or more of the C playback channels are synthesized by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
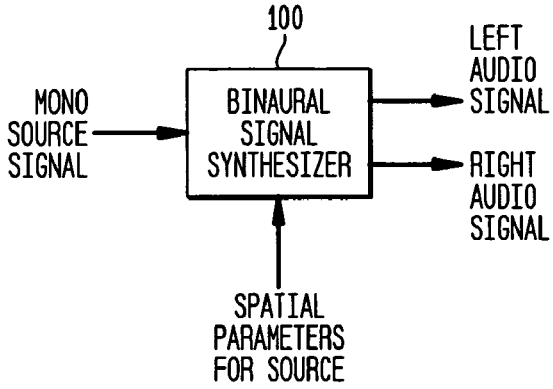
FIG. 1 (PRIOR ART)
FIG. 1 shows a high-level block diagram of conventional binaural signal synthesizer.

In binaural cue coding (BCC), an encoder encodes C input audio channels to generate E transmitted audio channels, where C>E≧1. In particular, two or more of the C input channels are provided in a frequency domain, and one or more cue codes are generated for each of one or more different frequency bands in the two or more input channels in the frequency domain. In addition, the C input channels are downmixed to generate the E transmitted channels. In some downmixing implementations, at least one of the E transmitted channels is based on two or more of the C input channels, and at least one of the E transmitted channels is based on only a single one of the C input channels.

In one embodiment, a BCC coder has two or more filter banks, a code estimator, and a downmixer. The two or more filter banks convert two or more of the C input channels from a time domain into a frequency domain. The code estimator generates one or more cue codes for each of one or more different frequency bands in the two or more converted input channels. The downmixer downmixes the C input channels to generate the E transmitted channels, where C>E≧1.

In BCC decoding, E transmitted audio channels are decoded to generate C playback audio channels. In particular, for each of one or more different frequency bands, one or more of the E transmitted channels are upmixed in a frequency domain to generate two or more of the C playback channels in the frequency domain, where C>E≧1. One or more cue codes are applied to each of the one or more different frequency bands in the two or more playback channels in the frequency domain to generate two or more modified channels, and the two or more modified channels are converted from the frequency domain into a time domain. In some upmixing implementations, at least one of the C playback channels is based on at least one of the E transmitted channels and at least one cue code, and at least one of the C playback channels is based on only a single one of the E transmitted channels and independent of any cue codes.

In one embodiment, a BCC decoder has an upmixer, a synthesizer, and one or more inverse filter banks. For each of one or more different frequency bands, the upmixer upmixes one or more of the E transmitted channels in a frequency domain to generate two or more of the C playback channels in the frequency domain, where $C>E\geqq 1$. The synthesizer applies one or more cue codes to each of the one or more different frequency bands in the two or more playback channels in the frequency domain to generate two or more modified channels. The one or more inverse filter banks convert the two or more modified channels from the frequency domain into a time domain.

Depending on the particular implementation, a given playback channel may be based on a single transmitted channel, rather than a combination of two or more transmitted channels. For example, when there is only one transmitted channel, each of the C playback channels is based on that one transmitted channel. In these situations, upmixing corresponds to copying of the corresponding transmitted channel. As such, for applications in which there is only one transmitted channel, the upmixer may be implemented using a replicator that copies the transmitted channel for each playback channel.

BCC encoders and/or decoders may be incorporated into a number of systems or applications including, for example, digital video recorders/players, digital audio recorders/players, computers, satellite transmitters/receivers, cable transmitters/receivers, terrestrial broadcast transmitters/receivers, home entertainment systems, and movie theater systems.

Generic BCC Processing

Figure 2:
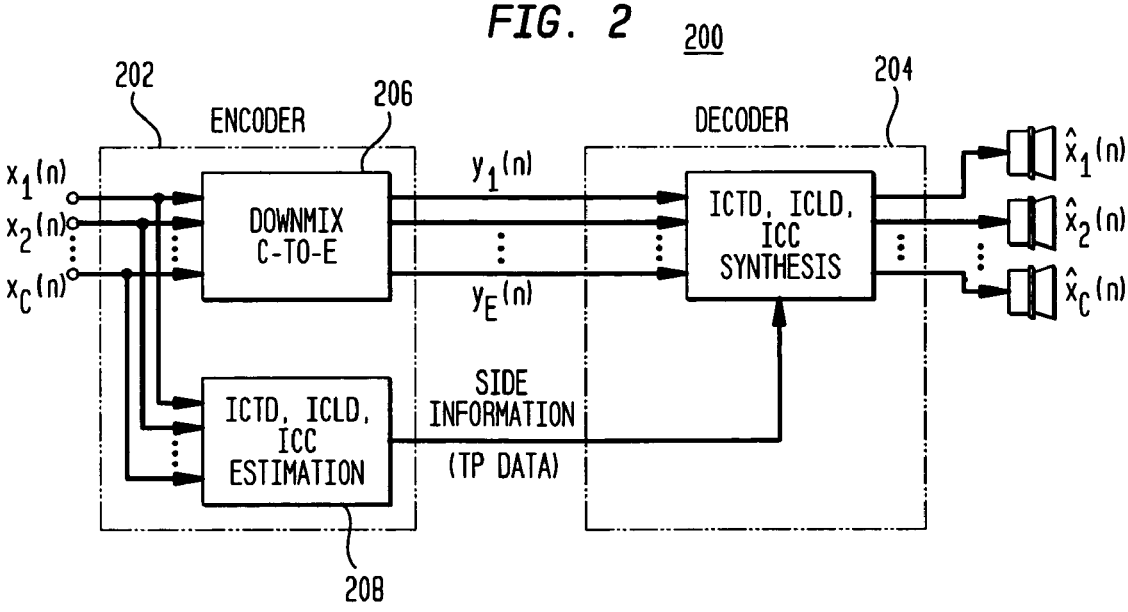
FIG. 2 is a block diagram of a generic binaural cue coding (BCC) audio processing system.

FIG. 2 is a block diagram of a generic binaural cue coding (BCC) audio processing system 200 comprising an encoder 202 and a decoder 204. Encoder 202 includes downmixer 206 and BCC estimator 208.

Downmixer 206 converts C input audio channels $x_i(n)$ into E transmitted audio channels $y_i(n)$, where $C>E\geqq 1$. In this specification, signals expressed using the variable n are time-domain signals, while signals expressed using the variable k are frequency-domain signals. Depending on the particular implementation, downmixing can be implemented in either the time domain or the frequency domain. BCC estimator 208 generates BCC codes from the C input audio channels and transmits those BCC codes as either in-band or out-of-band side information relative to the E transmitted audio channels. Typical BCC codes include one or more of inter-channel time difference (ICTD), inter-channel level difference (ICLD), and inter-channel correlation (ICC) data estimated between certain pairs of input channels as a function of frequency and time. The particular implementation will dictate between which particular pairs of input channels, BCC codes are estimated.

ICC data corresponds to the coherence of a binaural signal, which is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space. As such, ICC data is typically related to the apparent source width and degree of listener envelopment. See, e.g., J. Blauert, *The Psychophysics of Human Sound Localization*, MIT Press, 1983.

Depending on the particular application, the E transmitted audio channels and corresponding BCC codes may be transmitted directly to decoder 204 or stored in some suitable type of storage device for subsequent access by decoder 204. Depending on the situation, the term "transmitting" may refer to either direct transmission to a decoder or storage for subsequent provision to a decoder. In either case, decoder 204 receives the transmitted audio channels and side information and performs upmixing and BCC synthesis using the BCC codes to convert the E transmitted audio channels into more than E (typically, but not necessarily, C) playback audio channels $\hat{x}_i$ (n) for audio playback. Depending on the particular implementation, upmixing can be performed in either the time domain or the frequency domain.

In addition to the BCC processing shown in FIG. 2, a generic BCC audio processing system may include additional encoding and decoding stages to further compress the audio signals at the encoder and then decompress the audio signals at the decoder, respectively. These audio codecs may be based on conventional audio compression/decompression techniques such as those based on pulse code modulation (PCM), differential PCM (DPCM), or adaptive DPCM (ADPCM).

When downmixer 206 generates a single sum signal (i.e., E=1), BCC coding is able to represent multi-channel audio signals at a bitrate only slightly higher than what is required to represent a mono audio signal. This is so, because the estimated ICTD, ICLD, and ICC data between a channel pair contain about two orders of magnitude less information than an audio waveform.

Not only the low bitrate of BCC coding, but also its backwards compatibility aspect is of interest. A single transmitted sum signal corresponds to a mono downmix of the original stereo or multi-channel signal. For receivers that do not support stereo or multi-channel sound reproduction, listening to the transmitted sum signal is a valid method of presenting the audio material on low-profile mono reproduction equipment. BCC coding can therefore also be used to enhance existing services involving the delivery of mono audio material towards multi-channel audio. For example, existing mono audio radio broadcasting systems can be enhanced for stereo or multi-channel playback if the BCC side information can be embedded into the existing transmission channel. Analogous capabilities exist when downmixing multi-channel audio to two sum signals that correspond to stereo audio.

BCC processes audio signals with a certain time and frequency resolution. The frequency resolution used is largely motivated by the frequency resolution of the human auditory system. Psychoacoustics suggests that spatial perception is most likely based on a critical band representation of the acoustic input signal. This frequency resolution is considered by using an invertible filterbank (e.g., based on a fast Fourier transform (FFT) or a quadrature mirror filter (QMF)) with subbands with bandwidths equal or proportional to the critical bandwidth of the human auditory system.

Generic Downmixing

In preferred implementations, the transmitted sum signal(s) contain all signal components of the input audio signal. The goal is that each signal component is fully maintained. Simply summation of the audio input channels often results in amplification or attenuation of signal components. In other words, the power of the signal components in a "simple" sum is often larger or smaller than the sum of the power of the corresponding signal component of each channel. A downmixing technique can be used that equalizes the sum signal such that the power of signal components in the sum signal is approximately the same as the corresponding power in all input channels.

Figure 3:
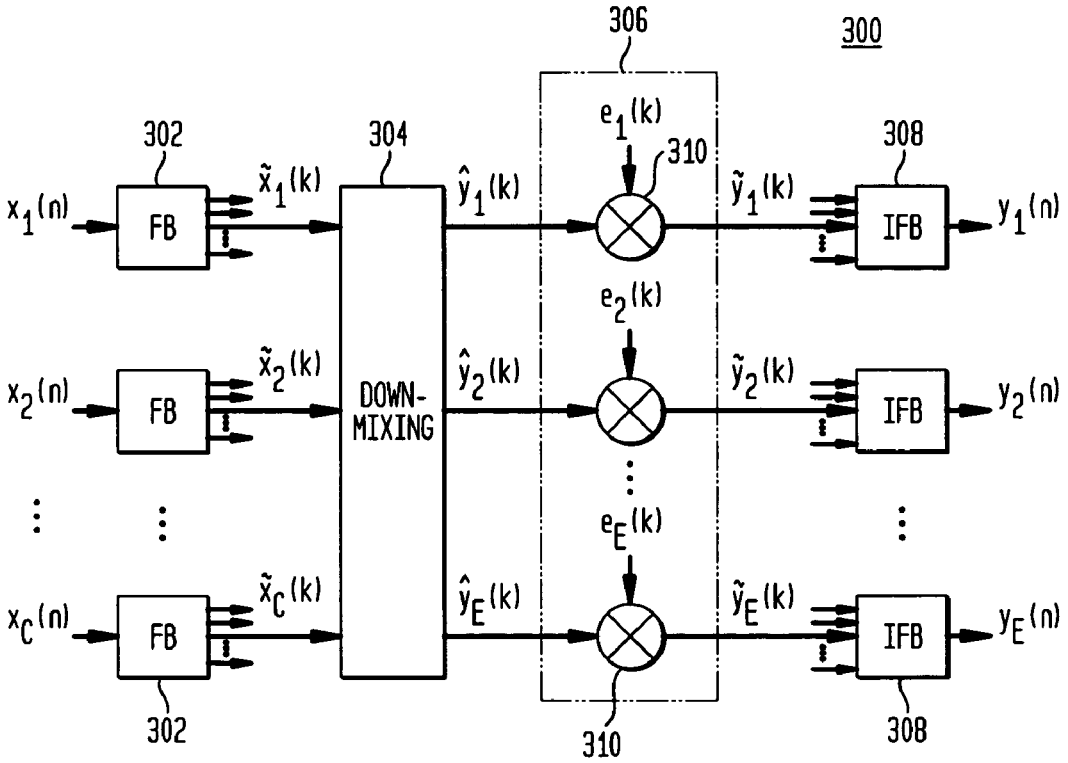
FIG. 3 shows a block diagram of a downmixer that can be used for the downmixer of FIG. 2.

FIG. 3 shows a block diagram of a downmixer 300 that can be used for downmixer 206 of FIG. 2 according to certain implementations of BCC system 200. Downmixer 300 has a filter bank (FB) 302 for each input channel $x_i(n)$, a downmixing block 304, an optional scaling/delay block 306, and an inverse FB (IFB) 308 for each encoded channel $y_i(n)$.

Each filter bank 302 converts each frame (e.g., 20 msec) of a corresponding digital input channel $x_i(n)$ in the time domain into a set of input coefficients $\tilde{x}_i(k)$ in the frequency domain. Downmixing block 304 downmixes each sub-band of C corresponding input coefficients into a corresponding sub-band of E downmixed frequency-domain coefficients. Equation (1) represents the downmixing of the kth sub-band of input coefficients $(\tilde{x}_1(k),\tilde{x}_2(k), \ldots, \tilde{x}_C(k))$ to generate the kth sub-band of downmixed coefficients $(\hat{y}_1(k),\hat{y}_2(k), \ldots, \hat{y}_E(k))$ as follows:

$$\begin{bmatrix} \hat{y}_1(k) \\ \hat{y}_2(k) \\ \vdots \\ \hat{y}_E(k) \end{bmatrix} = D_{CE} \begin{bmatrix} \tilde{x}_1(k) \\ \tilde{x}_2(k) \\ \vdots \\ \tilde{x}_C(k) \end{bmatrix}, \tag{1}$$

where $D_{CE}$ is a real-valued C-by-E downmixing matrix.

Optional scaling/delay block 306 comprises a set of multipliers 310, each of which multiplies a corresponding downmixed coefficient $\tilde{y}_i(k)$ by a scaling factor $e_i(k)$ to generate a corresponding scaled coefficient $\tilde{y}_i(k)$. The motivation for the scaling operation is equivalent to equalization generalized for downmixing with arbitrary weighting factors for each channel. If the input channels are independent, then the power $P_{y_i(k)}$ of the downmixed signal in each sub-band is given by Equation (2) as follows:

$$\begin{bmatrix} p_{\hat{y}_1(k)} \\ p_{\hat{y}_2(k)} \\ \vdots \\ p_{\hat{y}_E(k)} \end{bmatrix} = \overline{D}_{CE} \begin{bmatrix} p_{\tilde{x}_1(k)} \\ p_{\tilde{x}_2(k)} \\ \vdots \\ p_{\tilde{x}_C(k)} \end{bmatrix}, \tag{2}$$

where $D_{CE}$ is derived by squaring each matrix element in the C-by-E downmixing matrix $D_{CE}$ and $P_{x_i(k)}$ is the power of sub-band k of input channel i.

If the sub-bands are not independent, then the power values $P_{y_i(k)}$ of the downmixed signal will be larger or smaller than that computed using Equation (2), due to signal amplifications or cancellations when signal components are in-phase or out-of-phase, respectively. To prevent this, the downmixing operation of Equation (1) is applied in sub-bands followed by the scaling operation of multipliers 310. The scaling factors $e_i(k)$ $(1 \leqq i \leqq E)$ can be derived using Equation (3) as follows:

$$e_i(k) = \sqrt{\frac{p_{\hat{y}_i(k)}}{p_{\tilde{y}_i(k)}}}, \tag{3}$$

where $P_{y_i(k)}$ is the sub-band power as computed by Equation (2), and $P_{y_i(k)}$ is power of the corresponding downmixed sub-band signal $\hat{y}_i(k)$.

In addition to or instead of providing optional scaling, scaling/delay block 306 may optionally apply delays to the signals.

Each inverse filter bank 308 converts a set of corresponding scaled coefficients $\tilde{y}_i(k)$ in the frequency domain into a frame of a corresponding digital, transmitted channel $y_i(n)$.

Although FIG. 3 shows all C of the input channels being converted into the frequency domain for subsequent downmixing, in alternative implementations, one or more (but less than C−1) of the C input channels might bypass some or all of the processing shown in FIG. 3 and be transmitted as an equivalent number of unmodified audio channels. Depending on the particular implementation, these unmodified audio channels might or might not be used by BCC estimator 208 of FIG. 2 in generating the transmitted BCC codes.

In an implementation of downmixer 300 that generates a single sum signal y(n), E=1 and the signals $\tilde{x}_c(k)$ of each subband of each input channel c are added and then multiplied with a factor e(k), according to Equation (4) as follows:

$$\tilde{y}(k) = e(k) \sum_{c=1}^{C} \tilde{x}_c(k). \tag{4}$$

the factor e(k) is given by Equation (5) as follows:

$$e(k) = \sqrt{\frac{\sum_{c=1}^{C} p_{\tilde{x}_c}(k)}{p_{\tilde{x}}(k)}}, \tag{5}$$

where $P_{x_c}(k)$ is a short-time estimate of the power of $\tilde{x}_c(k)$ at time index k, and $P_x(k)$ is a short-time estimate of the power of $$\sum_{c=1}^{C} \tilde{x}_c(k).$$

The equalized subbands are transformed back to the time domain resulting in the sum signal y(n) that is transmitted to the BCC decoder.

Generic BCC Synthesis

Figure 4:
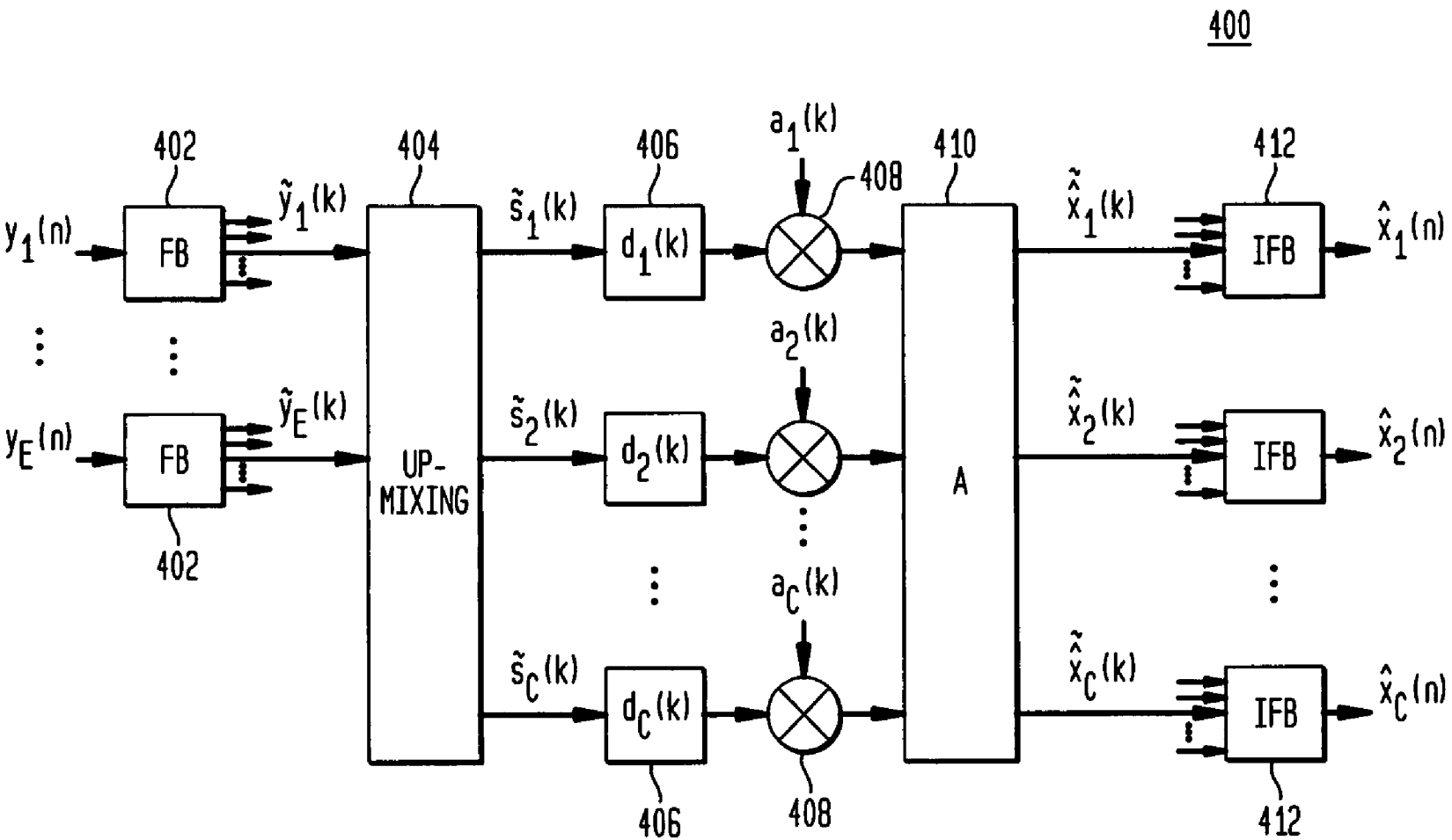
FIG. 4 shows a block diagram of a BCC synthesizer that can be used for the decoder of FIG. 2.

FIG. 4 shows a block diagram of a BCC synthesizer 400 that can be used for decoder 204 of FIG. 2 according to certain implementations of BCC system 200. BCC synthesizer 400 has a filter bank 402 for each transmitted channel $y_i(n)$, an upmixing block 404, delays 406, multipliers 408, correlation block 410, and an inverse filter bank 412 for each playback channel $\tilde{x}_i(n)$.

Each filter bank 402 converts each frame of a corresponding digital, transmitted channel $y_i(n)$ in the time domain into a set of input coefficients $\tilde{y}_i(k)$ in the frequency domain. Upmixing block 404 upmixes each sub-band of E corresponding transmitted-channel coefficients into a corresponding sub-band of C upmixed frequency-domain coefficients. Equation (4) represents the upmixing of the kth sub-band of transmitted-channel coefficients $(\tilde{y}_1(k),\tilde{y}_2(k), \ldots, \tilde{y}_E(k))$ to generate the kth sub-band of upmixed coefficients $(\tilde{s}_1(k),\tilde{s}_2(k), \ldots, \tilde{s}_C(k))$ as follows:

$$\begin{bmatrix} \tilde{s}_1(k) \\ \tilde{s}_2(k) \\ \vdots \\ \tilde{s}_C(k) \end{bmatrix} = U_{EC} \begin{bmatrix} \tilde{y}_1(k) \\ \tilde{y}_2(k) \\ \vdots \\ \tilde{y}_E(k) \end{bmatrix}, \quad (6)$$

where $U_{EC}$ is a real-valued E-by-C upmixing matrix. Performing upmixing in the frequency-domain enables upmixing to be applied individually in each different sub-band.

Each delay 406 applies a delay value $d_i(k)$ based on a corresponding BCC code for ICTD data to ensure that the desired ICTD values appear between certain pairs of playback channels. Each multiplier 408 applies a scaling factor $a_i(k)$ based on a corresponding BCC code for ICLD data to ensure that the desired ICLD values appear between certain pairs of playback channels. Correlation block 410 performs a decorrelation operation A based on corresponding BCC codes for ICC data to ensure that the desired ICC values appear between certain pairs of playback channels. Further description of the operations of correlation block 410 can be found in U.S. patent application Ser. No. 10/155,437, filed on May 24, 2002 Baumgarte 2-10.

The synthesis of ICLD values may be less troublesome than the synthesis of ICTD and ICC values, since ICLD synthesis involves merely scaling of sub-band signals. Since ICLD cues are the most commonly used directional cues, it is usually more important that the ICLD values approximate those of the original audio signal. As such, ICLD data might be estimated between all channel pairs. The scaling factors $a_i(k)$ ($1 \leqq i \leqq C$) for each sub-band are preferably chosen such that the sub-band power of each playback channel approximates the corresponding power of the original input audio channel.

One goal may be to apply relatively few signal modifications for synthesizing ICTD and ICC values. As such, the BCC data might not include ICTD and ICC values for all channel pairs. In that case, BCC synthesizer 400 would synthesize ICTD and ICC values only between certain channel pairs.

Each inverse filter bank 412 converts a set of corresponding synthesized coefficients $\hat{x}_i(k)$ in the frequency domain into a frame of a corresponding digital, playback channel $\hat{x}_i(n)$.

Although FIG. 4 shows all E of the transmitted channels being converted into the frequency domain for subsequent upmixing and BCC processing, in alternative implementations, one or more (but not all) of the E transmitted channels might bypass some or all of the processing shown in FIG. 4. For example, one or more of the transmitted channels may be unmodified channels that are not subjected to any upmixing. In addition to being one or more of the C playback channels, these unmodified channels, in turn, might be, but do not have to be, used as reference channels to which BCC processing is applied to synthesize one or more of the other playback channels. In either case, such unmodified channels may be subjected to delays to compensate for the processing time involved in the upmixing and/or BCC processing used to generate the rest of the playback channels.

Note that, although FIG. 4 shows C playback channels being synthesized from E transmitted channels, where C was also the number of original input channels, BCC synthesis is not limited to that number of playback channels. In general, the number of playback channels can be any number of channels, including numbers greater than or less than C and possibly even situations where the number of playback channels is equal to or less than the number of transmitted channels.

"Perceptually Relevant Differences" Between Audio Channels

Assuming a single sum signal, BCC synthesizes a stereo or multi-channel audio signal such that ICTD, ICLD, and ICC approximate the corresponding cues of the original audio signal. In the following, the role of ICTD, ICLD, and ICC in relation to auditory spatial image attributes is discussed.

Knowledge about spatial hearing implies that for one auditory event, ICTD and ICLD are related to perceived direction. When considering binaural room impulse responses (BRIRs) of one source, there is a relationship between width of the auditory event and listener envelopment and ICC data estimated for the early and late parts of the BRIRs. However, the relationship between ICC and these properties for general signals (and not just the BRIRs) is not straightforward.

Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC, which vary as a function of time and frequency. In this case, the relation between instantaneous ICTD, ICLD, and ICC and auditory event directions and spatial impression is not obvious. The strategy of certain embodiments of BCC is to blindly synthesize these cues such that they approximate the corresponding cues of the original audio signal.

Filterbanks with subbands of bandwidths equal to two times the equivalent rectangular bandwidth (ERB) are used. Informal listening reveals that the audio quality of BCC does not notably improve when choosing higher frequency resolution. A lower frequency resolution may be desired, since it results in less ICTD, ICLD, and ICC values that need to be transmitted to the decoder and thus in a lower bitrate.

Regarding time resolution, ICTD, ICLD, and ICC are typically considered at regular time intervals. High performance is obtained when ICTD, ICLD, and ICC are considered about every 4 to 16 ms. Note that, unless the cues are considered at very short time intervals, the precedence effect is not directly considered. Assuming a classical lead-lag pair of sound stimuli, if the lead and lag fall into a time interval where only one set of cues is synthesized, then localization dominance of the lead is not considered. Despite this, BCC achieves audio quality reflected in an average MUSHRA score of about 87 (i.e., "excellent" audio quality) on average and up to nearly 100 for certain audio signals.

The often-achieved perceptually small difference between reference signal and synthesized signal implies that cues related to a wide range of auditory spatial image attributes are implicitly considered by synthesizing ICTD, ICLD, and ICC at regular time intervals. In the following, some arguments are given on how ICTD, ICLD, and ICC may relate to a range of auditory spatial image attributes.

Estimation of Spatial Cues

In the following, it is described how ICTD, ICLD, and ICC are estimated. The bitrate for transmission of these (quantized and coded) spatial cues can be just a few kb/s and thus, with BCC, it is possible to transmit stereo and multi-channel audio signals at bitrates close to what is required for a single audio channel.

Figure 5:
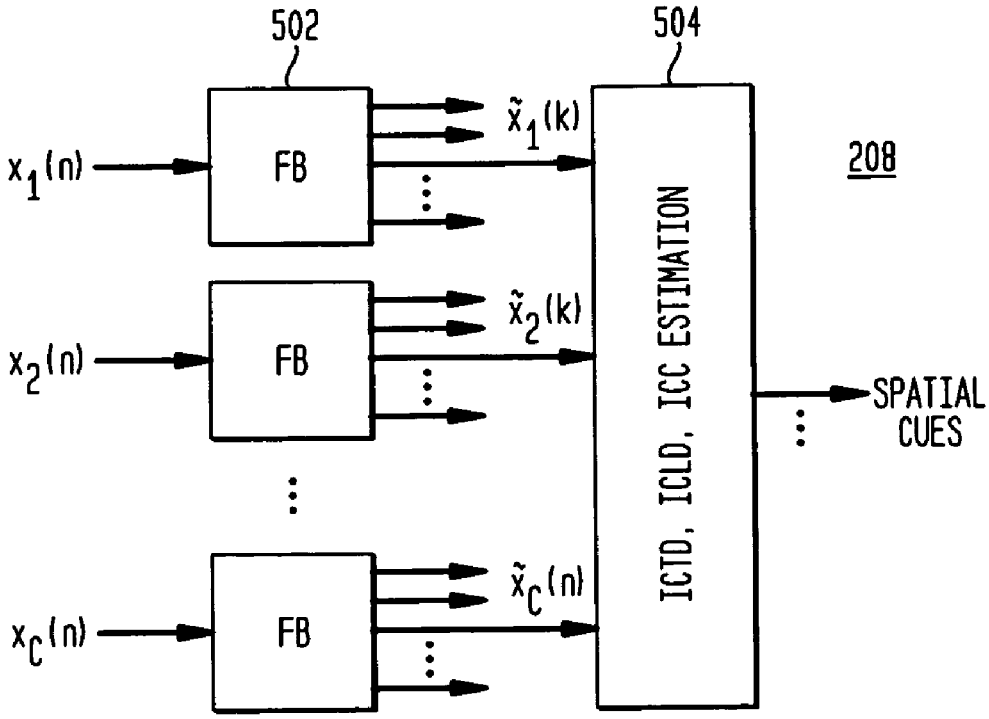
FIG. 5 shows a block diagram of the BCC estimator of FIG. 2, according to one embodiment of the present invention.

FIG. 5 shows a block diagram of BCC estimator 208 of FIG. 2, according to one embodiment of the present invention. BCC estimator 208 comprises filterbanks (FB) 502, which may be the same as filterbanks 302 of FIG. 3, and estimation block 504, which generates ICTD, ICLD, and ICC spatial cues for each different frequency subband generated by filterbanks 502.

Estimation of ICTD, ICLD, and ICC for Stereo Signals

The following measures are used for ICTD, ICLD, and ICC for corresponding subband signals $\tilde{x}_1(k)$ and $\tilde{x}_2(k)$ of two (e.g., stereo) audio channels:

○ *ICTD* [sample]: (7)

$$\tau_{12}(k) = \arg\max_d \{\Phi_{12}(d, k)\},$$

with a short-time estimate of the normalized cross-correlation function given by Equation (8) as follows:

$$\Phi_{12}(d, k) = \frac{p_{\tilde{x}_1\tilde{x}_2}(d, k)}{\sqrt{p_{\tilde{x}_1}(k, -d_1)p_{\tilde{x}_2}(k - d_2)}}, \quad (8)$$

where $$d_1 = \max\{-d, 0\} \quad (9)$$
$$d_2 = \max\{d, 0\},$$

and $P_{\tilde{x}_1\tilde{x}_2}(d, k)$ is a short-time estimate of the mean of $\tilde{x}_1(k-d_1)\tilde{x}_2(k-d_2)$.

○ *ICLD* [dB]: (10)

$$\Delta L_{12}(k) = 10\log_{10}\left(\frac{p_{\tilde{x}_2}(k)}{p_{\tilde{x}_1}(k)}\right).$$

○ *ICC*: (11)

$$c_{12}(k) = \max_d |\Phi_{12}(d, k)|.$$

Note that the absolute value of the normalized cross-correlation is considered and $c_{12}(k)$ has a range of [0,1].

Estimation of ICTD, ICLD, and ICC for Multi-channel Audio Signals

Figure 6:
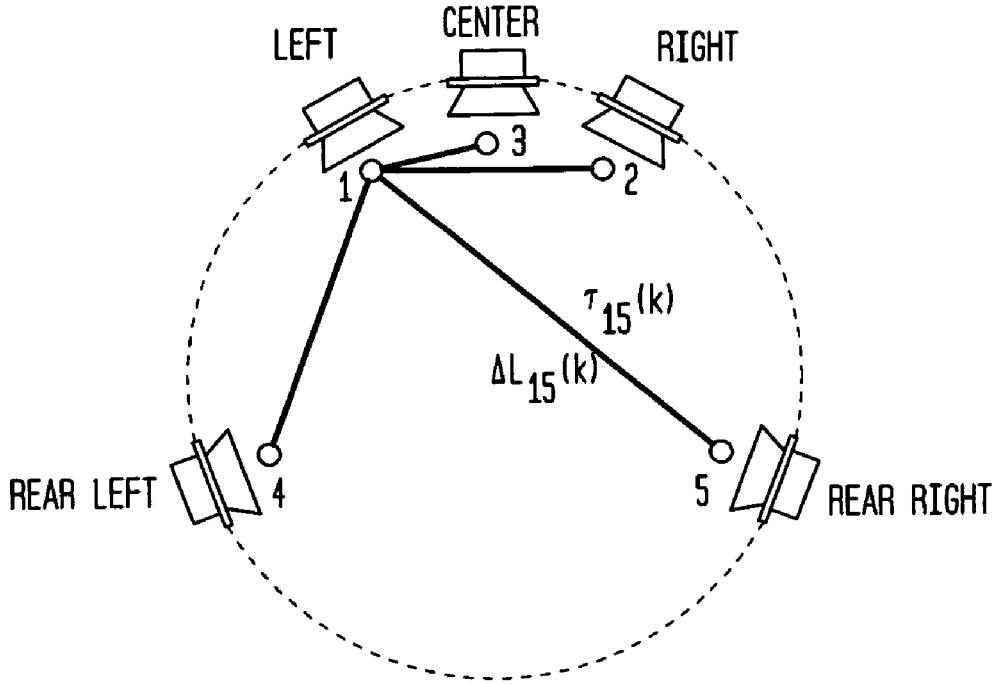
FIG. 6 illustrates the generation of ICTD and ICLD data for five-channel audio.

When there are more than two input channels, it is typically sufficient to define ICTD and ICLD between a reference channel (e.g., channel number 1) and the other channels, as illustrated in FIG. 6 for the case of C=5 channels where $\tau_{1c}(k)$ and $\Delta L_{12}(k)$ denote the ICTD and ICLD, respectively, between the reference channel 1 and channel c.

Figure 7A:
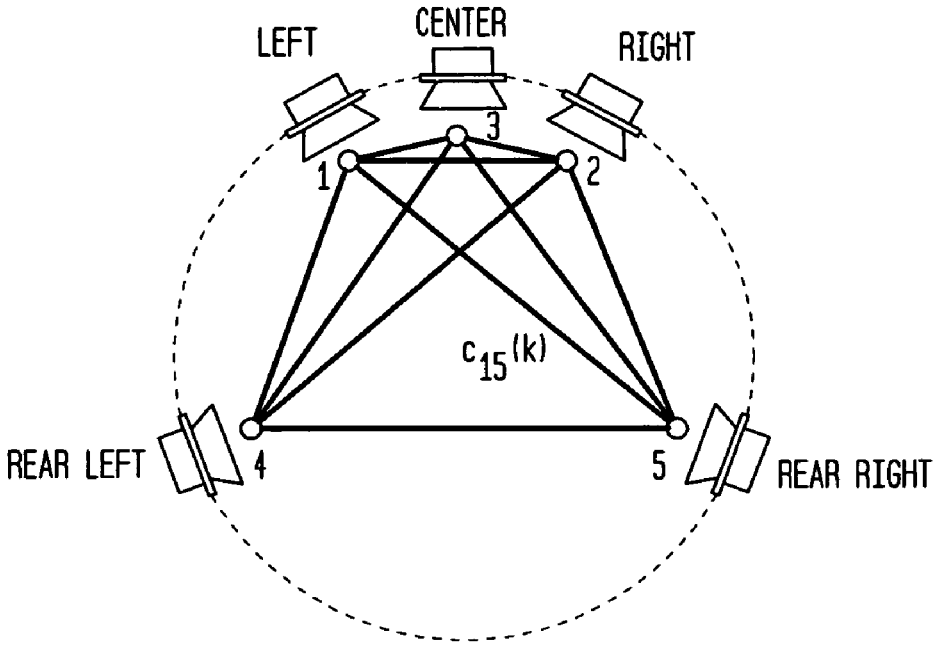
FIG. 7 illustrates the generation of ICC data for five-channel audio.
Figure 7B:
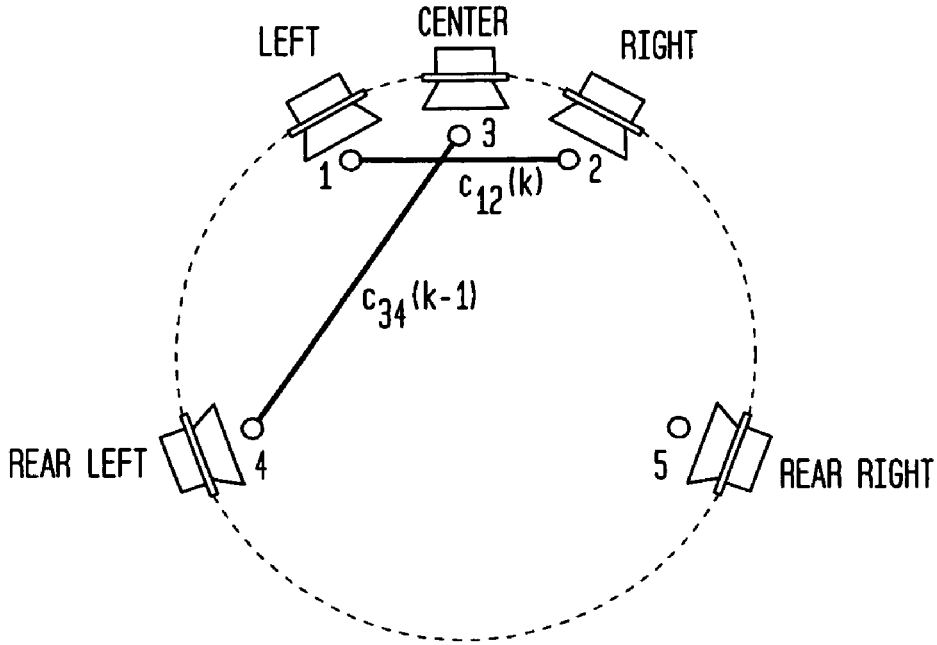

As opposed to ICTD and ICLD, ICC typically has more degrees of freedom. The ICC as defined can have different values between all possible input channel pairs. For C channels, there are C(C−1)/2 possible channel pairs; e.g., for 5 channels there are 10 channel pairs as illustrated in FIG. 7(*a*). However, such a scheme requires that, for each subband at each time index, C(C−1)/2 ICC values are estimated and transmitted, resulting in high computational complexity and high bitrate.

Alternatively, for each subband, ICTD and ICLD determine the direction at which the auditory event of the corresponding signal component in the subband is rendered. One single ICC parameter per subband may then be used to describe the overall coherence between all audio channels. Good results can be obtained by estimating and transmitting ICC cues only between the two channels with most energy in each subband at each time index. This is illustrated in FIG. 7(*b*), where for time instants k−1 and k the channel pairs (3, 4) and (1, 2) are strongest, respectively. A heuristic rule may be used for determining ICC between the other channel pairs.

Synthesis of Spatial Cues

Figure 8:
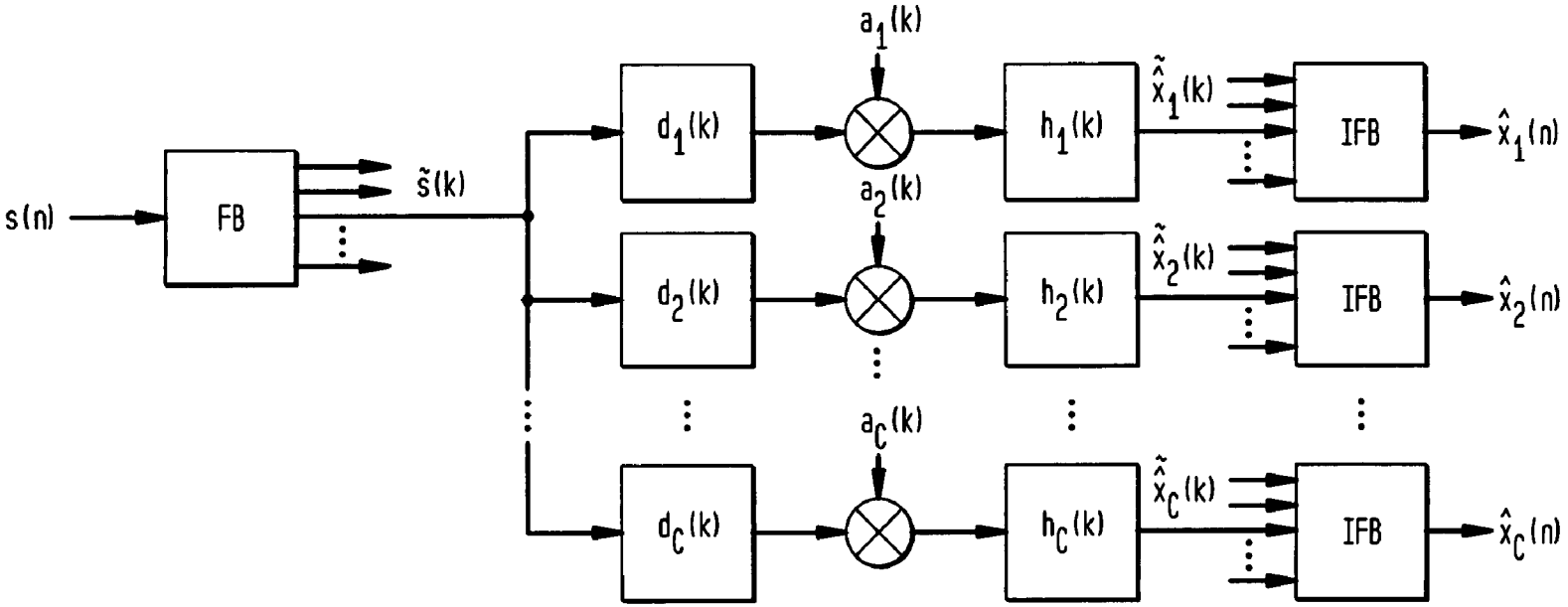
FIG. 8 shows a block diagram of an implementation of the BCC synthesizer of FIG. 4 that can be used in a BCC decoder to generate a stereo or multi-channel audio signal given a single transmitted sum signal s(n) plus the spatial cues.

FIG. 8 shows a block diagram of an implementation of BCC synthesizer 400 of FIG. 4 that can be used in a BCC decoder to generate a stereo or multi-channel audio signal given a single transmitted sum signal s(n) plus the spatial cues. The sum signal s(n) is decomposed into subbands, where $\tilde{s}(k)$ denotes one such subband. For generating the corresponding subbands of each of the output channels, delays $d_c$, scale factors $a_c$, and filters $h_c$ are applied to the corresponding subband of the sum signal. (For simplicity of notation, the time index k is ignored in the delays, scale factors, and filters.) ICTD are synthesized by imposing delays, ICLD by scaling, and ICC by applying de-correlation filters. The processing shown in FIG. 8 is applied independently to each subband.

ICTD synthesis

The delays $d_c$ are determined from the ICTDs $\tau_{1c}(k)$, according to Equation (12) as follows:

$$d_c = \begin{cases} -\frac{1}{2}\left(\max_{2\le l\le C} \tau_{1l}(k) + \min_{2\le l\le C} \tau_{1l}(k)\right), & c = 1 \\ \tau_{1l}(k) + d_1 & 2 \le c \le C. \end{cases} \quad (12)$$

The delay for the reference channel, $d_1$, is computed such that the maximum magnitude of the delays $d_c$ is minimized. The less the subband signals are modified, the less there is a danger for artifacts to occur. If the subband sampling rate does not provide high enough time-resolution for ICTD synthesis, delays can be imposed more precisely by using suitable all-pass filters.

ICLD Synthesis

In order that the output subband signals have desired ICLDs $\Delta L_{12}(k)$ between channel c and the reference channel 1, the gain factors $a_c$ should satisfy Equation (13) as follows:

$$\frac{a_c}{a_1} = 10^{\frac{\Delta L_{1c}(k)}{20}}. \quad (13)$$

Additionally, the output subbands are preferably normalized such that the sum of the power of all output channels is equal to the power of the input sum signal. Since the total original signal power in each subband is preserved in the sum signal, this normalization results in the absolute subband power for each output channel approximating the corresponding power of the original encoder input audio signal. Given these constraints, the scale factors $a_c$ are given by Equation (14) as follows:

$$a_c = \begin{cases} 1\Big/\sqrt{1 + \sum_{i=2}^{C} 10^{\Delta L_{1i}/10}}, & c = 1 \\ 10^{\Delta L_{1c}/20} a_1, & \text{otherwise.} \end{cases} \quad (14)$$

ICC Synthesis

In certain embodiments, the aim of ICC synthesis is to reduce correlation between the subbands after delays and scaling have been applied, without affecting ICTD and ICLD. This can be achieved by designing the filters $h_c$ in FIG. 8 such that ICTD and ICLD are effectively varied as a function of frequency such that the average variation is zero in each subband (auditory critical band).

Figure 9:
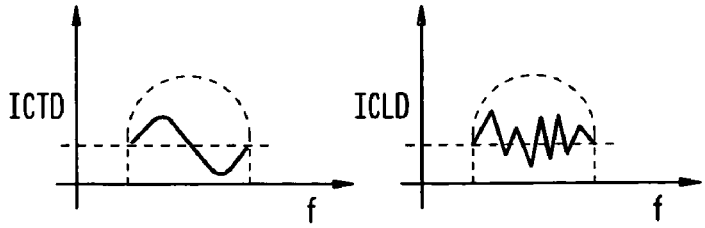
FIG. 9 illustrates how ICTD and ICLD are varied within a subband as a function of frequency.

FIG. 9 illustrates how ICTD and ICLD are varied within a subband as a function of frequency. The amplitude of ICTD and ICLD variation determines the degree of de-correlation and is controlled as a function of ICC. Note that ICTD are varied smoothly (as in FIG. 9(*a*)), while ICLD are varied randomly (as in FIG. 9(*b*)). One could vary ICLD as smoothly as ICTD, but this would result in more coloration of the resulting audio signals.

Another method for synthesizing ICC, particularly suitable for multi-channel ICC synthesis, is described in more detail in C. Faller, "Parametric multi-channel audio coding: Synthesis of coherence cues," *IEEE Trans. on Speech and Audio Proc.*, 2003, the teachings of which are incorporated herein by reference. As a function of time and frequency, specific amounts of artificial late reverberation are added to each of the output channels for achieving a desired ICC. Additionally, spectral modification can be applied such that the spectral envelope of the resulting signal approaches the spectral envelope of the original audio signal.

Other related and unrelated ICC synthesis techniques for stereo signals (or audio channel pairs) have been presented in E. Schuijers, W. Oomen, B. den Brinker, and J. Breebaart, "Advances in parametric coding for high-quality audio," in *Preprint* 114$^{th}$ *Conv. Aud. Eng. Soc.*, March 2003, and J. Engdegard, H. Pumhagen, J. Roden, and L. Liljeryd, "Synthetic ambience in parametric stereo coding," in *Preprint* 117$^{th}$ *Conv. Aud. Eng. Soc.*, May 2004, the teachings of both of which are incorporated here by reference.

C-to-E BCC

As described previously, BCC can be implemented with more than one transmission channel. A variation of BCC has been described which represents C audio channels not as one single (transmitted) channel, but as E channels, denoted C-to-E BCC. There are (at least) two motivations for C-to-E BCC:

- BCC with one transmission channel provides a backwards compatible path for upgrading existing mono systems for stereo or multi-channel audio playback. The upgraded systems transmit the BCC downmixed sum signal through the existing mono infrastructure, while additionally transmitting the BCC side information. C-to-E BCC is applicable to E-channel backwards compatible coding of C-channel audio.
- C-to-E BCC introduces scalability in terms of different degrees of reduction of the number of transmitted channels. It is expected that the more audio channels that are transmitted, the better the audio quality will be.

Signal processing details for C-to-E BCC, such as how to define the ICTD, ICLD, and ICC cues, are described in U.S. application Ser. No. 10/762,100, filed on Jan 20, 2004 (Faller 13-1).

Individual Channel Shaping

In certain embodiments, both BCC with one transmission channel and C-to-E BCC involve algorithms for ICTD, ICLD, and/or ICC synthesis. Usually, it is enough to synthesize the ICTD, ICLD, and/or ICC cues about every 4 to 30 ms. However, the perceptual phenomenon of precedence effect implies that there are specific time instants when the human auditory system evaluates cues at higher time resolution (e.g., every 1 to 10 ms).

A single static filterbank typically cannot provide high enough frequency resolution, suitable for most time instants, while providing high enough time resolution at time instants when the precedence effect becomes effective.

Certain embodiments of the present invention are directed to a system that uses relatively low time resolution ICTD, ICLD, and/or ICC synthesis, while adding additional processing to address the time instants when higher time resolution is required. Additionally, in certain embodiments, the system eliminate the need for signal adaptive window switching technology which is usually hard to integrate in a system's structure. In certain embodiments, the temporal envelopes of one or more of the original encoder input audio channels are estimated. This can be done, e.g., directly by analysis of the signal's time structure or by examining the autocorrelation of the signal spectrum over frequency. Both approaches will be elaborated on further in the subsequent implementation examples. The information contained in these envelopes is transmitted to the decoder (as envelope cue codes) if perceptually required and advantageous.

In certain embodiments, the decoder applies certain processing to impose these desired temporal envelopes on its output audio channels:

- This can be achieved by TP processing, e.g., manipulation of the signal's envelope by multiplication of the signal's time-domain samples with a time-varying amplitude modification function. A similar processing can be applied to spectral/subband samples if the time resolution of the subbands is sufficiently high enough (at the cost of a coarse frequency resolution).
- Alternatively, a convolution/filtering of the signal's spectral representation over frequency can be used in a manner analogous to that used in the prior art for the purpose of shaping the quantization noise of a low-bitrate audio coder or for enhancing intensity stereo coded signals. This is preferred if the filterbank has a high frequency resolution and therefor a rather low time resolution. For the convolution/filtering approach:
- The envelope shaping method is extended from intensity stereo to C-to-E multi-channel coding.
- The technique comprises a setup where the envelope shaping is controlled by parametric information (e.g., binary flags) generated by the encoder but is actually carried out using decoder-derived filter coefficient sets.
- In another setup, sets of filter coefficients are transmitted from the encoder, e.g., only when perceptually necessary and/or beneficial.

The same is also true for the time domain/subband domain approach. Therefore, criteria (e.g., transient detection and a tonality estimate) can be introduced to additionally control transmission of envelope information.

There may be situations when it is favorable to disable the TP processing in order to avoid potential artifacts. In order to be on the safe side, it is a good strategy to leave the temporal processing disabled by default (i.e., BCC would operate according to a conventional BCC scheme). The additional processing is enabled only when it is expected that higher temporal resolution of the channels yields improvement, e.g., when it is expected that the precedence effect becomes active.

As stated earlier, this enabling/disabling control can be achieved by transient detection. That is, if a transient is detected, then TP processing is enabled. The precedence effect is most effective for transients. Transient detection can be used with look-ahead to effectively shape not only single transients but also the signal components shortly before and after the transient. Possible ways of detecting transients include:

Observing the temporal envelope of BCC encoder input signals or transmitted BCC sum signal(s). If there is a sudden increase in power, then a transient occurred.

Examining the linear predictive coding (LPC) gain as estimated in the encoder or decoder. If the LPC prediction gain exceeds a certain threshold, then it can be assumed that the signal is transient or highly fluctuating. The LPC analysis is computed on the spectrum's autocorrelation.

Additionally, to prevent possible artifacts in tonal signals, TP processing is preferably not applied when the tonality of the transmitted sum signal(s) is high.

According to certain embodiments of the present invention, the temporal envelopes of the individual original audio channels are estimated at a BCC encoder in order to enable a BCC decoder generate output channels with temporal envelopes similar (or perceptually similar) to those of the original audio channels. Certain embodiments of the present invention address the phenomenon of precedence effect. Certain embodiments of the present invention involve the transmission of envelope cue codes in addition to other BCC codes, such as ICLD, ICTD, and/or ICC, as part of the BCC side information.

In certain embodiments of the present invention, the time resolution for the temporal envelope cues is finer than the time resolution of other BCC codes (e.g., ICLD, ICTD, ICC). This enables envelope shaping to be performed within the time period provided by a synthesis window that corresponds to the length of a block of an input channel for which the other BCC codes are derived.

Implementation Examples

Figure 10A:
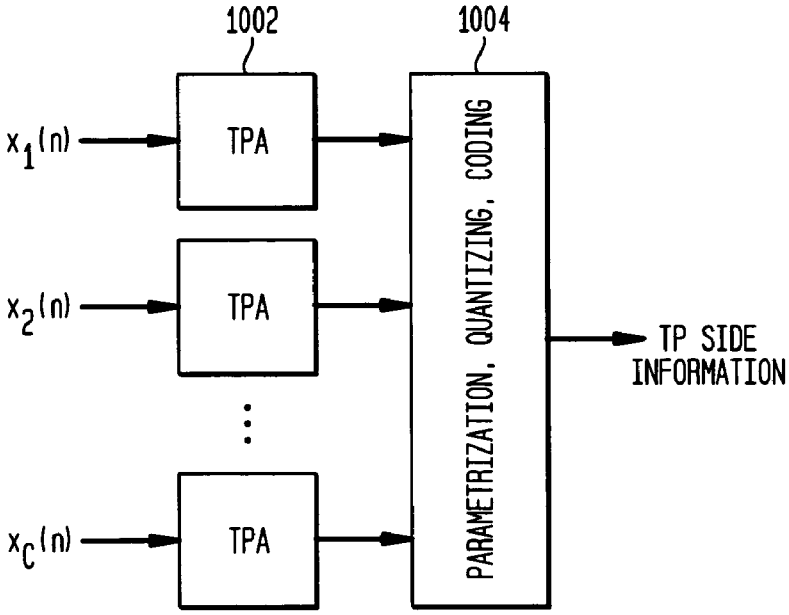
FIG. 10 shows a block diagram of time-domain processing that is added to a BCC encoder, such as the encoder of FIG. 2, according to one embodiment of the present invention.
Figure 10B:
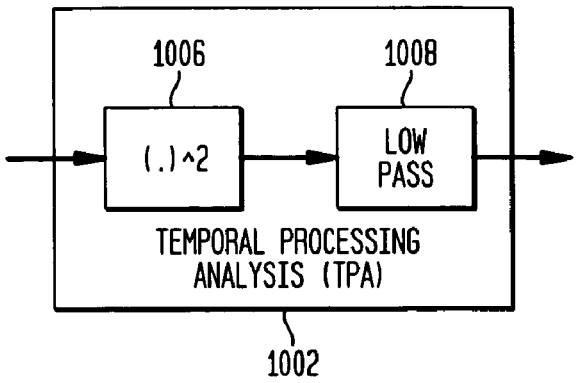

FIG. 10 shows a block diagram of time-domain processing that is added to a BCC encoder, such as encoder 202 of FIG. 2, according to one embodiment of the present invention. As shown in FIG. 10(*a*), each temporal process analyzer (TPA) 1002 estimates the temporal envelope of a different original input channel $x_c(n)$, although in general any one or more of the input channels can be analyzed.

FIG. 10(*b*) shows a block diagram of one possible time domain-based implementation of TPA 1002 in which the input signal samples are squared (1006) and then low-pass filtered (1008) to characterize the temporal envelope of the input signal. In alternative embodiments, the temporal envelope can be estimated using an autocorrelation/LPC method or with other methods, e.g., using a Hilbert transform.

Block 1004 of FIG. 10(*a*) parameterizes, quantizes, and codes the estimated temporal envelopes prior to transmission as temporal processing (TP) information (i.e., envelope cue codes) that is included in the side information of FIG. 2.

In one embodiment, a detector (not shown) within block 1004 determines whether TP processing at the decoder will improve audio quality, such that block 1004 transmits TP side information only during those time instants when audio quality will be improved by TP processing.

Figure 11A:
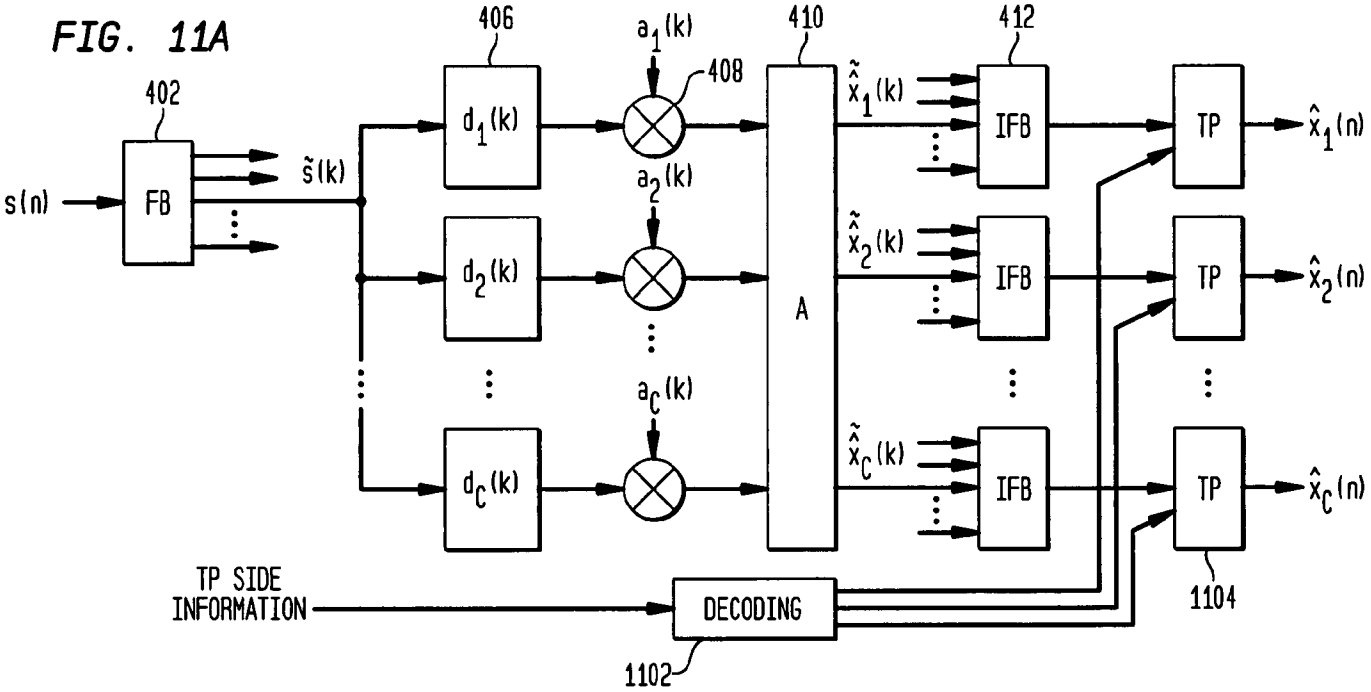
FIG. 11 illustrates an exemplary time-domain application of TP processing in the context of the BCC synthesizer of FIG. 4.
Figure 11B:
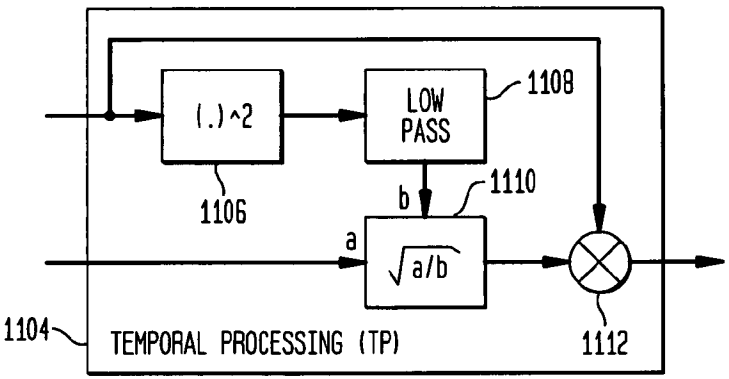

FIG. 11 illustrates an exemplary time-domain application of TP processing in the context of BCC synthesizer 400 of FIG. 4. In this embodiment, there is a single transmitted sum signal s(n), C base signals are generated by replicating that sum signal, and envelope shaping is individually applied to different synthesized channels. In alternative embodiments, the order of delays, scaling, and other processing may be different. Moreover, in alternative embodiments, envelope shaping is not restricted to processing each channel independently. This is especially true for convolution/filtering-based implementations that exploit coherence over frequency bands to derive information on the signal's temporal fine structure.

In FIG. 11(*a*), decoding block 1102 recovers temporal envelope signals a for each output channel from the transmitted TP side information received from the BCC encoder, and each TP block 1104 applies the corresponding envelope information to shape the envelope of the output channel.

FIG. 11(*b*) shows a block diagram of one possible time domain-based implementation of TP 1104 in which the synthesized signal samples are squared (1106) and then low-pass filtered (1108) to characterize the temporal envelope b of the synthesized channel. A scale factor (e.g., sqrt (a/b)) is generated (1110) and then applied (1112) to the synthesized channel to generate an output signal having a temporal envelope substantially equal to that of the corresponding original input channel.

In alternative implementations of TPA 1002 of FIG. 10 and TP 1104 of FIG. 11, the temporal envelopes are characterized using magnitude operations rather than by squaring the signal samples. In such implementations, the ratio a/b may be used as the scale factor without having to apply the square root operation.

Although the scaling operation of FIG. 11(*c*) corresponds to a time domain-based implementation of TP processing, TP processing (as well as TPA and inverse TP (ITP) processing) can also be implemented using frequency-domain signals, as in the embodiment of FIGS. 16-17 (described below). As such, for purposes of this specification, the term "scaling function" should be interpreted to cover either time-domain or frequency-domain operations, such as the filtering operations of FIGS. 17(*b*) and (*c*).

In general, each TP 1104 is preferably designed such that it does not modify signal power (i.e., energy). Depending on the particular implementation, this signal power may be a short-time average signal power in each channel, e.g., based on the total signal power per channel in the time period defined by the synthesis window or some other suitable measure of power. As such, scaling for ICLD synthesis (e.g., using multipliers 408) can be applied before or after envelope shaping.

Since full-band scaling of the BCC output signals may result in artifacts, envelope shaping might be applied only at specified frequencies, for example, frequencies larger than a certain cut-off frequency $f_{TP}$ (e.g., 500 Hz). Note that the frequency range for analysis (TPA) may differ from the frequency range for synthesis (TP).

Figure 12A:
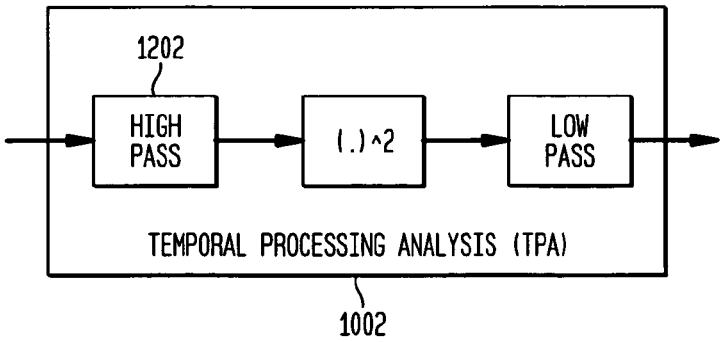
FIGS. 12(*a*) and (*b*) show possible implementations of the TPA of FIG. 10 and the TP of FIG. 11, respectively, where envelope shaping is applied only at frequencies higher than the cut-off frequency $f_{TP}$.
Figure 12B:
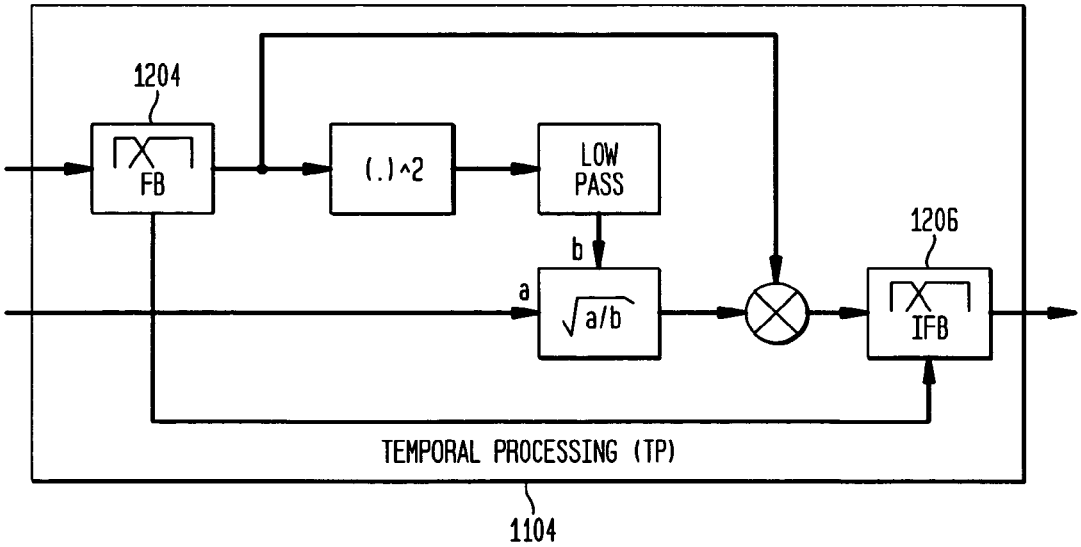

FIGS. 12(*a*) and (*b*) show possible implementations of TPA 1002 of FIG. 10 and TP 1104 of FIG. 11 where envelope shaping is applied only at frequencies higher than the cut-off frequency $f_{TP}$. In particular, FIG. 12(*a*) shows the addition of high-pass filter 1202, which filters out frequencies lower than $f_{TP}$ prior to temporal envelope characterization. FIG. 12(*b*) shows the addition of two-band filterbank 1204 having with a cut-off frequency of $f_{TP}$ between the two subbands, where only the high-frequency part is temporally shaped. Two-band inverse filterbank 1206 then recombines the low-frequency part with the temporally shaped, high-frequency part to generate the output channel.

Figure 13A:
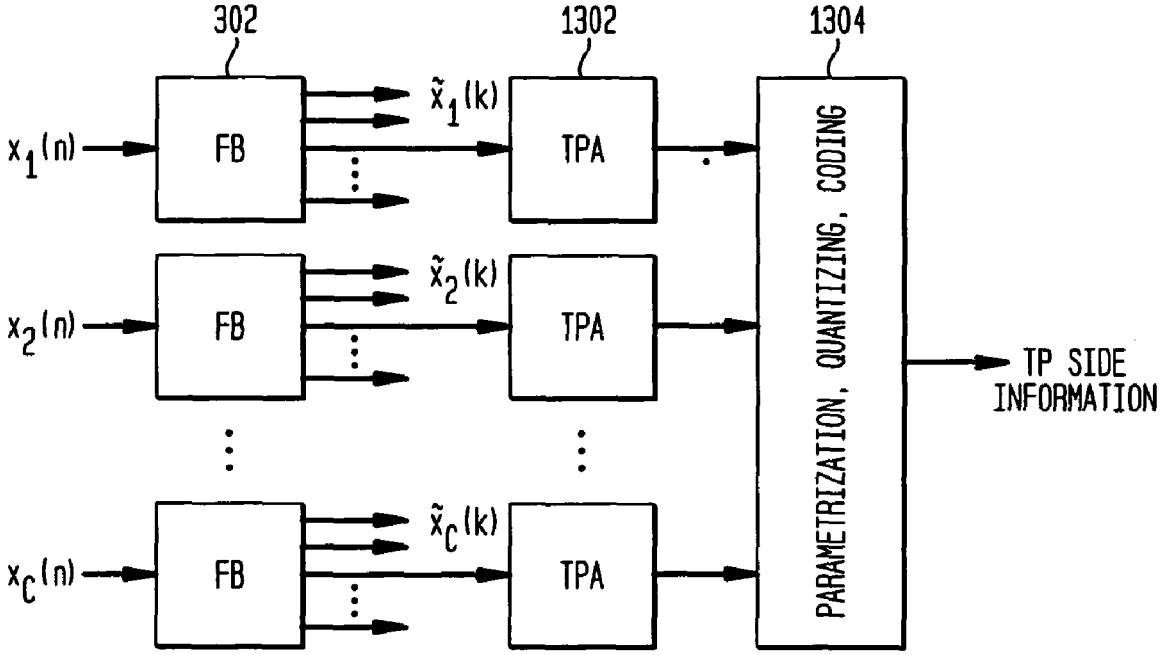
FIG. 13 shows a block diagram of frequency-domain processing that is added to a BCC encoder, such as the encoder of FIG. 2, according to an alternative embodiment of the present invention.
Figure 13B:
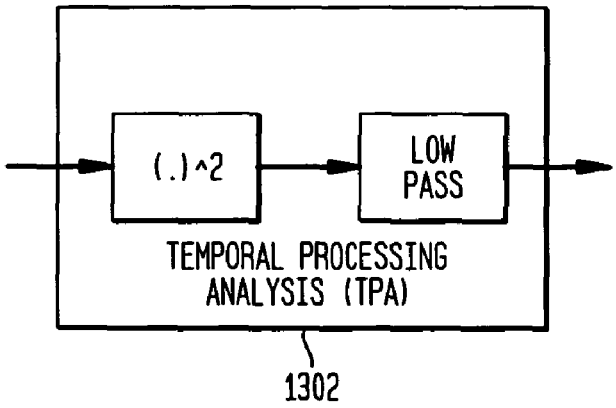

FIG. 13 shows a block diagram of frequency-domain processing that is added to a BCC encoder, such as encoder 202 of FIG. 2, according to an alternative embodiment of the present invention. As shown in FIG. 13(*a*), the processing of each TPA 1302 is applied individually in a different subband, where each filterbank (FB) is the same as a corresponding FB 302 of FIG. 3 and block 1304 is a subband implementation analogous to block 1004 of FIG. 10. In alternative implementations, the subbands for TPA processing may differ from the BCC subbands. As shown in FIG. 13(*b*), TPA 1302 can be implemented analogous to TPA 1002 of FIG. 10.

Figure 14A:
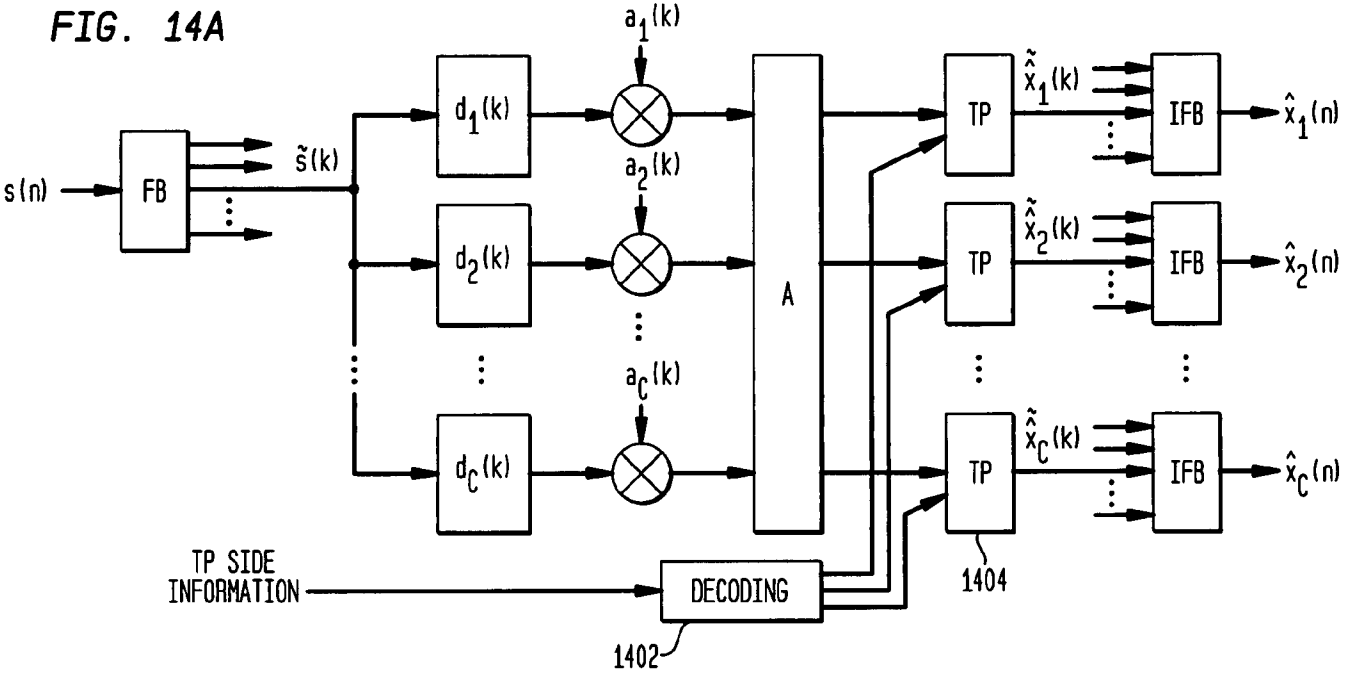
FIG. 14 illustrates an exemplary frequency-domain application of TP processing in the context of the BCC synthesizer of FIG. 4.
Figure 14B:
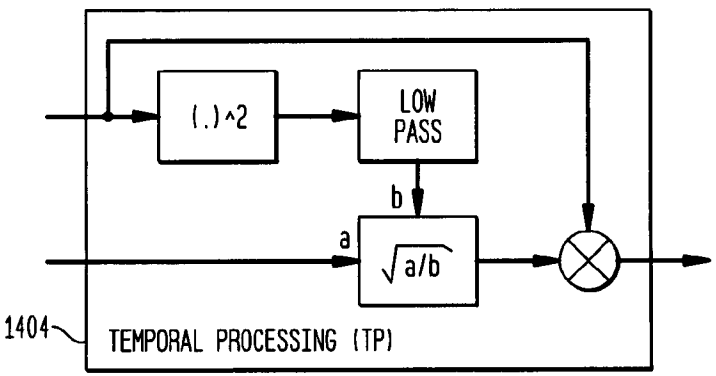

FIG. 14 illustrates an exemplary frequency-domain application of TP processing in the context of BCC synthesizer 400 of FIG. 4. Decoding block 1402 is analogous to decoding block 1102 of FIG. 11, and each TP 1404 is a subband implementation analogous to each TP 1104 of FIG. 11, as shown in FIG. 14(*b*).

Figure 15:
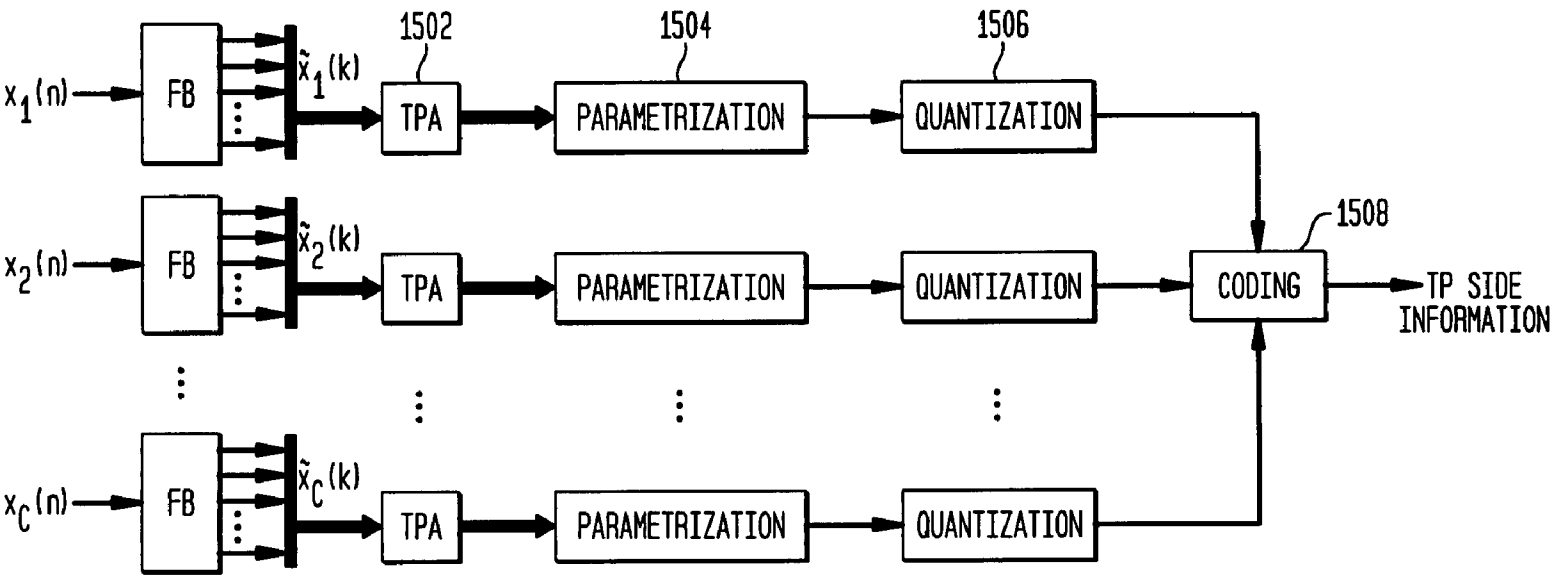
FIG. 15 shows a block diagram of frequency-domain processing that is added to a BCC encoder, such as the encoder of FIG. 2, according to another alternative embodiment of the present invention.

FIG. 15 shows a block diagram of frequency-domain processing that is added to a BCC encoder, such as encoder 202 of FIG. 2, according to another alternative embodiment of the present invention. This scheme has the following setup: The envelope information for every input channel is derived by calculation of LPC across frequency (1502), parameterized (1504), quantized (1506), and coded into the bitstream (1508) by the encoder. FIG. 17(*a*) illustrates an implementation example of the TPA 1502 of FIG. 15. The side information to be transmitted to the multichannel synthesizer (decoder) could be the LPC filter coefficients computed by an autocorrelation method, the resulting reflection coefficients, or line spectral pairs, etc., or, for the sake of keeping the side information data rate small, parameters derived from, e.g., the LPC prediction gain like "transients present/not present" binary flags.

Figure 16:
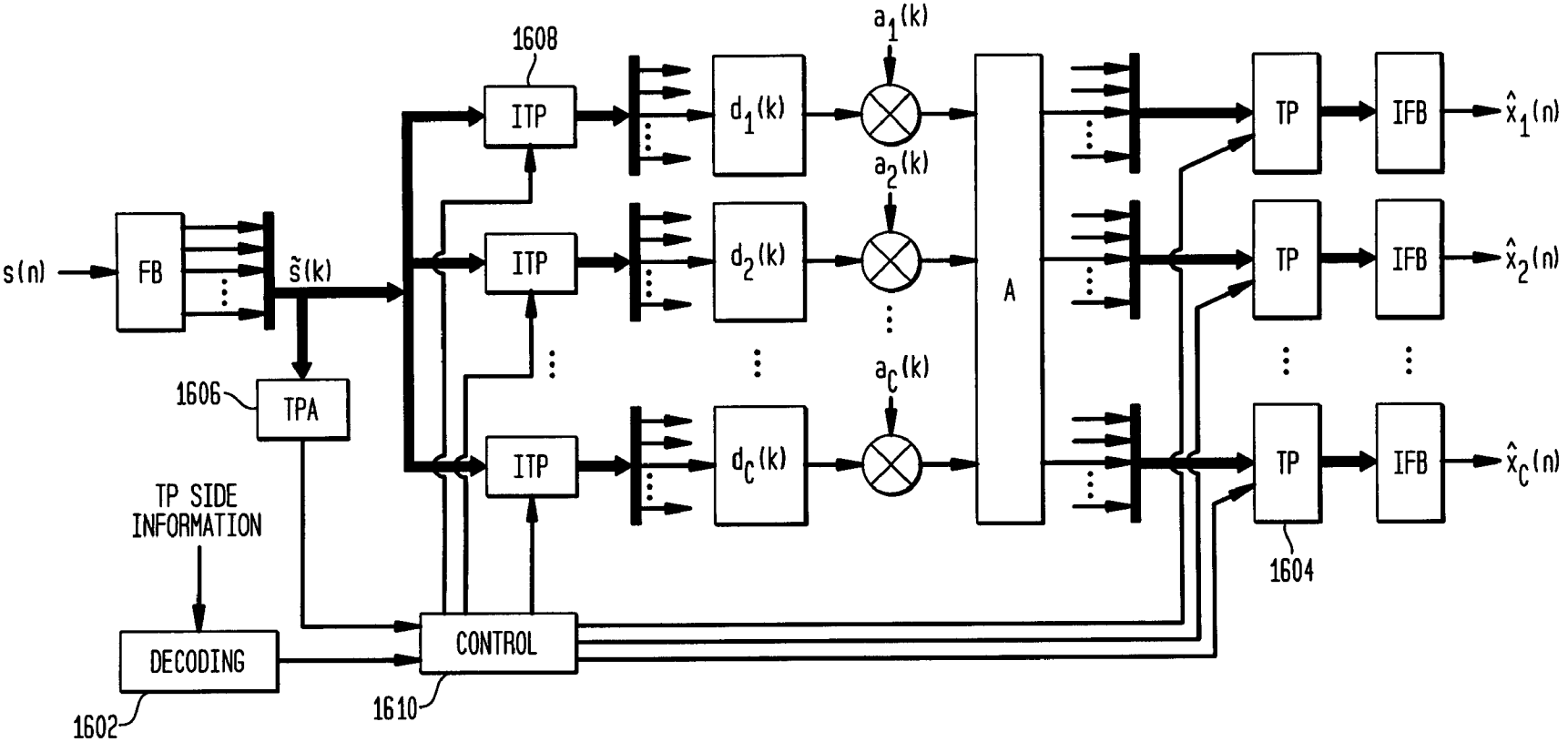
FIG. 16 illustrates another exemplary frequency-domain application of TP processing in the context of the BCC synthesizer of FIG. 4.
Figure 17A:
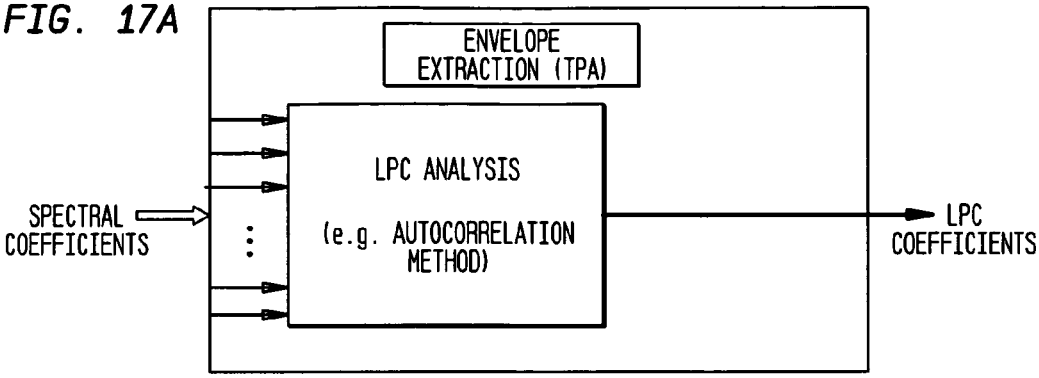
FIGS. 17(*a*)-(*c*) show block diagrams of possible implementations of the TPAs of FIGS. 15 and 16 and the ITP and TP of FIG. 16.
Figure 17B:
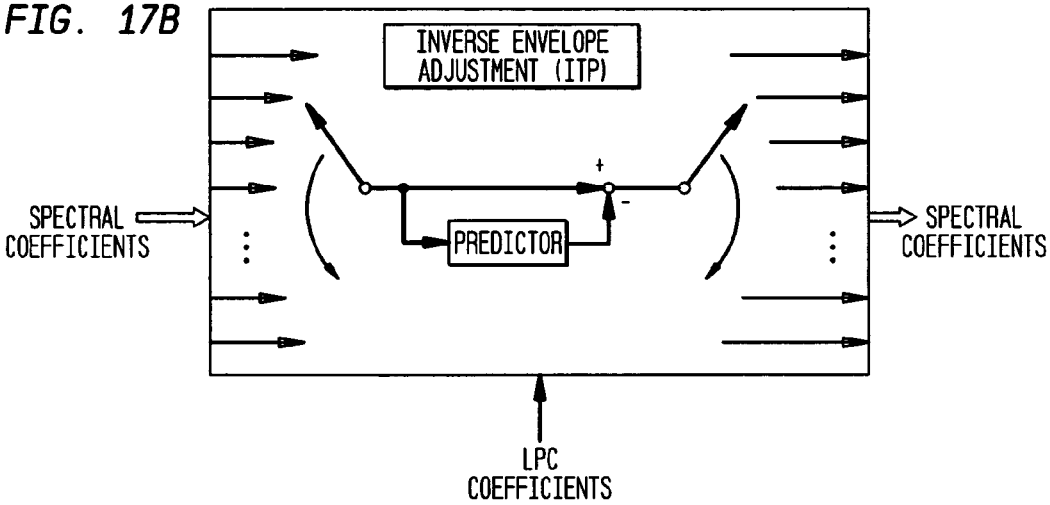
Figure 17C:
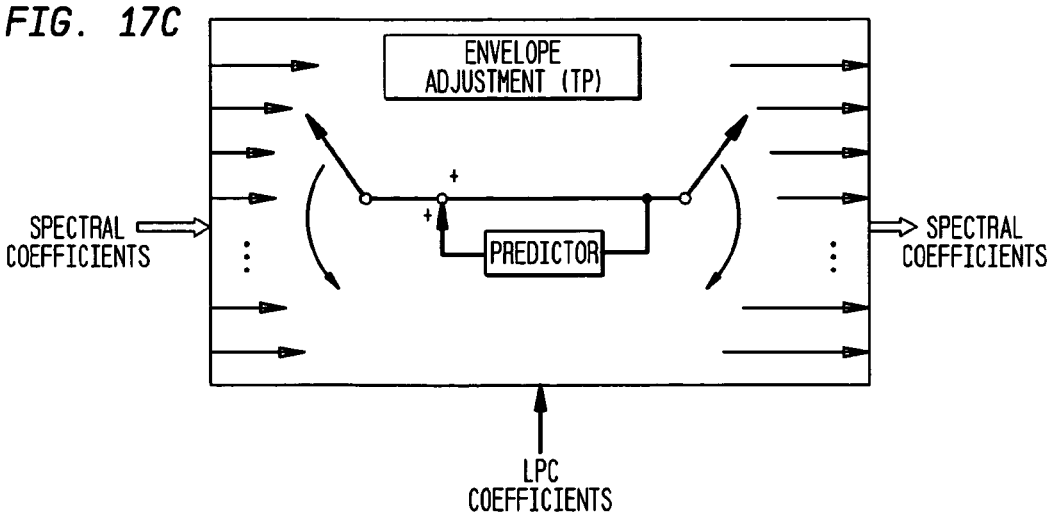

FIG. 16 illustrates another exemplary frequency-domain application of TP processing in the context of BCC synthesizer 400 of FIG. 4. The encoding processing of FIG. 15 and the decoding processing of FIG. 16 may be implemented to form a matched pair of an encoder/decoder configuration. Decoding block 1602 is analogous to decoding block 1402 of FIG. 14, and each TP 1604 is analogous to each TP 1404 of FIG. 14. In this multichannel synthesizer, transmitted TP side information is decoded and used for controlling the envelope shaping of individual channels. In addition, however, the synthesizer includes an envelope characterizer stage (TPA) 1606 for analysis of the transmitted sum signals, an inverse TP (ITP) 1608 for "flattening" the temporal envelope of each base signal, where envelope adjusters (TP) 1604 impose a modified envelope on each output channel. Depending on the particular implementation, ITP can be applied either before or after upmixing. In detail, this is done using the convolution/filtering approach where envelope shaping is achieved by applying LPC-based filters on the spectrum across frequency as illustrated in FIGS. 17(*a*), (*b*), and (*c*) for TPA, ITP, and TP processing, respectively. In FIG. 16, control block 1610 determines whether or not envelope shaping is to be implemented and, if so, whether it is to be based on (1) the transmitted TP side information or (2) the locally characterized envelope data from TPA 1606.

Figure 18A:
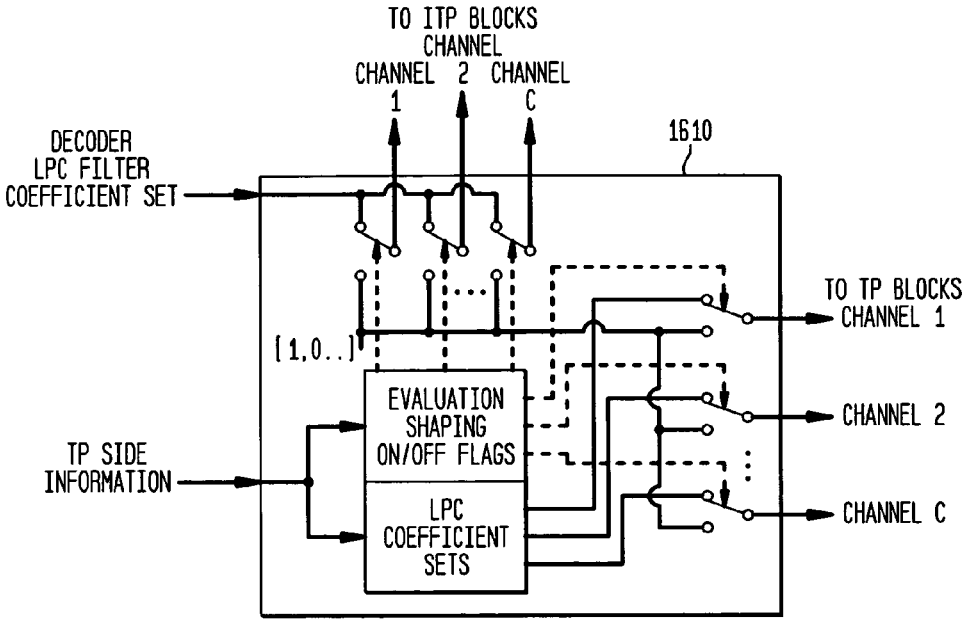
FIGS. 18(*a*) and (*b*) illustrate two exemplary modes of operating the control block of FIG. 16.
Figure 18B:
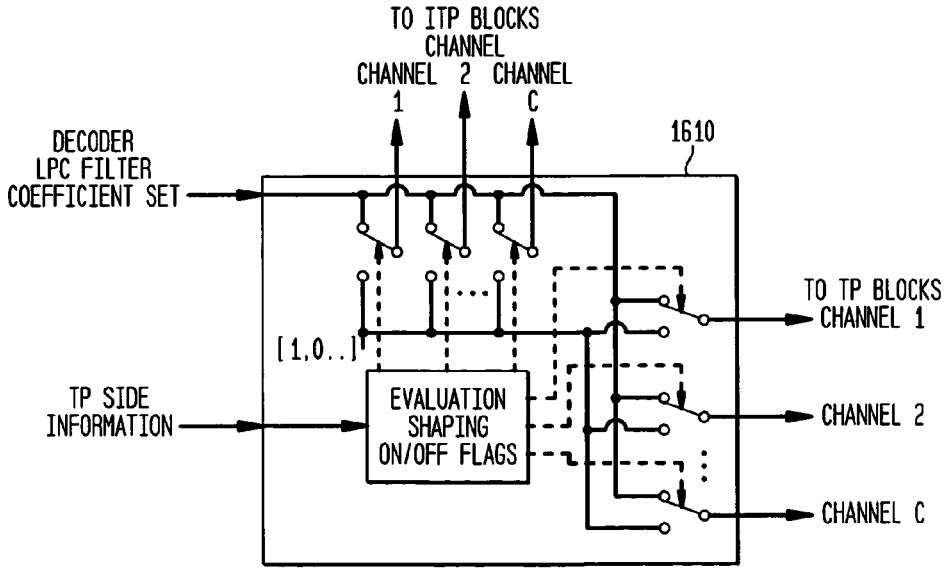

FIGS. 18(*a*) and (*b*) illustrate two exemplary modes of operating control block 1610 of FIG. 16. In the implementation of FIG. 18(*a*), a set of filter coefficients is transmitted to the decoder, and envelope shaping by convolution/filtering is done based on the transmitted coefficients. If transient shaping is detected to be not beneficial by the encoder, then no filter data is sent and the filters are disabled (shown in FIG. 18(*a*) by switching to a unity filter coefficient set "[1,0. . .]").

In the implementation of FIG. 18(*b*), only a "transient/non transient flag" is transmitted for each channel and this flag is used to activate or deactivate shaping based on filter coefficient sets calculated from the transmitted downmix signals in the decoder.

Further Alternative Embodiments

Although the present invention has been described in the context of BCC coding schemes in which there is a single sum signal, the present invention can also be implemented in the context of BCC coding schemes having two or more sum signals. In this case, the temporal envelope for each different "base" sum signal can be estimated before applying BCC synthesis, and different BCC output channels may be generated based on different temporal envelopes, depending on which sum signals were used to synthesize the different output channels. An output channel that is synthesized from two or more different sum channels could be generated based on an effective temporal envelope that takes into account (e.g., via weighted averaging) the relative effects of the constituent sum channels.

Although the present invention has been described in the context of BCC coding schemes involving ICTD, ICLD, and ICC codes, the present invention can also be implemented in the context of other BCC coding schemes involving only one or two of these three types of codes (e.g., ICLD and ICC, but not ICTD) and/or one or more additional types of codes. Moreover, the sequence of BCC synthesis processing and envelope shaping may vary in different implementations. For example, when envelope shaping is applied to frequency-domain signals, as in FIGS. 14 and 16, envelope shaping could alternatively be implemented after ICTD synthesis (in those embodiments that employ ICTD synthesis), but prior to ICLD synthesis. In other embodiments, envelope shaping could be applied to upmixed signals before any other BCC synthesis is applied.

Although the present invention has been described in the context of BCC encoders that generate envelope cue codes from the original input channels, in alternative embodiments, the envelope cue codes could be generated from downmixed channels corresponding to the original input channels. This would enable the implementation of a processor (e.g., a separate envelope cue coder) that could (1) accept the output of a BCC encoder that generates the downmixed channels and certain BCC codes (e.g., ICLD, ICTD, and/or ICC) and (2) characterize the temporal envelope(s) of one or more of the downmixed channels to add envelope cue codes to the BCC side information.

Although the present invention has been described in the context of BCC coding schemes in which the envelope cue codes are transmitted with one or more audio channels (i.e., the E transmitted channels) along with other BCC codes, in alternative embodiments, the envelope cue codes could be transmitted, either alone or with other BCC codes, to a place (e.g., a decoder or a storage device) that already has the transmitted channels and possibly other BCC codes.

Although the present invention has been described in the context of BCC coding schemes, the present invention can also be implemented in the context of other audio processing systems in which audio signals are de-correlated or other audio processing that needs to de-correlate signals.

Although the present invention has been described in the context of implementations in which the encoder receives input audio signal in the time domain and generates transmitted audio signals in the time domain and the decoder receives the transmitted audio signals in the time domain and generates playback audio signals in the time domain, the present invention is not so limited. For example, in other implementations, any one or more of the input, transmitted, and playback audio signals could be represented in a frequency domain.

BCC encoders and/or decoders may be used in conjunction with or incorporated into a variety of different applications or systems, including systems for television or electronic music distribution, movie theaters, broadcasting, streaming, and/or reception. These include systems for encoding/decoding transmissions via, for example, terrestrial, satellite, cable, internet, intranets, or physical media (e.g., compact discs, digital versatile discs, semiconductor chips, hard drives, memory cards, and the like). BCC encoders and/or decoders may also be employed in games and game systems, including, for example, interactive software products intended to interact with a user for entertainment (action, role play, strategy, adventure, simulations, racing, sports, arcade, card, and board games) and/or education that may be published for multiple machines, platforms, or media. Further, BCC encoders and/or decoders may be incorporated in audio recorders/players or CD-ROM/DVD systems. BCC encoders and/or decoders may also be incorporated into PC software applications that incorporate digital decoding (e.g., player, decoder) and software applications incorporating digital encoding capabilities (e.g., encoder, ripper, recoder, and jukebox).

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

We claim:

1. An encoder-implemented method for encoding audio channels, the method comprising:

an encoder generating one or more cue codes for one or more audio channels, wherein at least one cue code is an envelope cue code generated by characterizing a temporal envelope in one of the one or more audio channels; and the encoder transmitting the one or more cue codes, wherein:

the one or more cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

2. The invention of claim 1, further comprising transmitting E transmitted audio channel(s) corresponding to the one or more audio channels, where $E \geqq 1$.

3. The invention of claim 2, wherein:

the one or more audio channels comprise C input audio channels, where $C>E$; and the C input channels are downmixed to generate the E transmitted channel(s).

4. The invention of claim 1, wherein the one or more cue codes are transmitted to enable a decoder to perform envelope shaping during decoding of E transmitted channel(s) based on the one or more cue codes, wherein the E transmitted audio channel(s) correspond to the one or more audio channels, where $E \geqq 1$.

5. The invention of claim 4, wherein the envelope shaping adjusts a temporal envelope of a synthesized signal generated by the decoder to substantially match the characterized temporal envelope.

6. The invention of claim 1, wherein the temporal envelope is characterized only for specified frequencies of the corresponding audio channel.

7. The invention of claim 6, wherein the temporal envelope is characterized only for frequencies of the corresponding audio channel above a specified cutoff frequency.

8. The invention of claim 1, wherein the temporal envelope is characterized for the corresponding audio channel in a frequency domain.

9. The invention of claim 8, wherein temporal envelopes are characterized individually for different signal subbands in the corresponding audio channel.

10. The invention of claim 8, wherein the frequency domain corresponds to a fast Fourier transform (FFT).

11. The invention of claim 8, wherein the frequency domain corresponds to a quadrature mirror filter (QMF).

12. The invention of claim 1, wherein the temporal envelope is characterized for the corresponding audio channel in a time domain.

13. The invention of claim 1, further comprising determining whether to enable or disable the characterizing.

14. The invention of claim 13, further comprising generating and transmitting an enable/disable flag based on the determining to instruct a decoder whether or not to implement envelope shaping during decoding of E transmitted channel(s) corresponding to the one or more audio channels, where $E \geqq 1$.

15. The invention of claim 13, wherein the determining is based on analyzing an audio channel to detect transients in the audio channel such that the characterizing is enabled if occurrence of a transient is detected.

16. Apparatus for encoding audio channels, the apparatus comprising:

means for generating one or more cue codes for one or more audio channels, wherein at least one cue code is an envelope cue code generated by characterizing a temporal envelope in one of the one or more audio channels; and means for transmitting the one or more cue codes, wherein:

the one or more cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

17. Apparatus for encoding C input audio channels to generate E transmitted audio channel(s), the apparatus comprising:

an envelope analyzer adapted to characterize an input temporal envelope of at least one of the C input channels;

a code estimator adapted to generate cue codes for two or more of the C input channels; and a downmixer adapted to downmix the C input channels to generate the E transmitted channel(s), where $C>E\geqq 1$, wherein the apparatus is adapted to transmit information about the cue codes and the characterized input temporal envelope to enable a decoder to perform synthesis and envelope shaping during decoding of the E transmitted channel(s), wherein:

the cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

18. The invention of claim 17, wherein:

the apparatus is a system selected from the group consisting of a digital video recorder, a digital audio recorder, a computer, a satellite transmitter, a cable transmitter, a terrestrial broadcast transmitter, a home entertainment system, and a movie theater system; and the system comprises the envelope analyzer, the code estimator, and the downmixer.

19. A machine-readable storage medium, having encoded thereon program code, wherein, when the program code is executed by a machine, the machine implements a method for encoding audio channels, the method comprising:

generating one or more cue codes for one or more audio channels, wherein at least one cue code is an envelope cue code generated by characterizing a temporal envelope in one of the one or more audio channels; and transmitting the one or more cue codes, wherein:

the one or more cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

20. A machine-readable storage medium, having encoded thereon an encoded audio bitstream generated by encoding audio channels, wherein:

one or more cue codes are generated for one or more audio channels, wherein at least one cue code is an envelope cue code generated by characterizing a temporal envelope in one of the one or more audio channels;

the one or more cue codes and E transmitted audio channel(s) corresponding to the one or more audio channels, where $E\geqq 1$, are encoded onto the machine-readable medium as part of the encoded audio bitstream;

the one or more cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

21. A machine-readable storage medium, having encoded thereon an encoded audio bitstream comprising one or more cue codes and E transmitted audio channel(s), wherein:

the one or more cue codes are generated for one or more audio channels, wherein at least one cue code is an envelope cue code generated by characterizing a temporal envelope in one of the one or more audio channels;

the E transmitted audio channel(s) correspond to the one or more audio channels;

the one or more cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

22. A decoder-implemented method for decoding E transmitted audio channel(s) to generate C playback audio channels, where $C>E\geqq 1$, the method comprising:

a decoder receiving cue codes corresponding to the E transmitted channel(s), wherein the cue codes comprise an envelope cue code corresponding to a characterized temporal envelope of an audio channel corresponding to the E transmitted channel(s);

the decoder upmixing one or more of the E transmitted channel(s) to generate one or more upmixed channels; and the decoder synthesizing one or more of the C playback channels by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope, wherein:

the cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

23. The invention of claim 22, wherein the envelope cue code corresponds to a characterized temporal envelope in an original input channel used to generate the E transmitted channel(s).

24. The invention of claim 22, wherein the synthesis comprises late-reverberation ICC synthesis.

25. The invention of claim 22, wherein the temporal envelope of the synthesized signal is adjusted prior to ICLD synthesis.

26. The invention of claim 22, wherein:

the temporal envelope of the synthesized signal is characterized; and the temporal envelope of the synthesized signal is adjusted based on both the characterized temporal envelope corresponding to the envelope cue code and the characterized temporal envelope of the synthesized signal.

27. The invention of claim 26, wherein:

a scaling function is generated based on the characterized temporal envelope corresponding to the envelope cue code and the characterized temporal envelope of the synthesized signal; and the scaling function is applied to the synthesized signal.

28. The invention of claim 22, further comprising adjusting a transmitted channel based on the characterized temporal envelope to generate a flattened channel, wherein the upmixing and synthesis are applied to the flattened channel to generate a corresponding playback channel.

29. The invention of claim 22, further comprising adjusting an upmixed channel based on the characterized temporal envelope to generate a flattened channel, wherein the synthesis is applied to the flattened channel to generate a corresponding playback channel.

30. The invention of claim 22, wherein the temporal envelope of the synthesized signal is adjusted only for specified frequencies.

31. The invention of claim 30, wherein the temporal envelope of the synthesized signal is adjusted only for frequencies above a specified cutoff frequency.

32. The invention of claim 22, wherein the temporal envelope of the synthesized signal is adjusted in a frequency domain.

33. The invention of claim 32, wherein temporal envelopes are adjusted individually for different signal subbands in the synthesized signal.

34. The invention of claim 32, wherein the frequency domain corresponds to a fast Fourier transform (FFT).

35. The invention of claim 32, wherein the frequency domain corresponds to a quadrature mirror filter (QMF).

36. The invention of claim 22, wherein the temporal envelope of the synthesized signal is adjusted in a time domain.

37. The invention of claim 22, further comprising determining whether to enable or disable the adjusting of the temporal envelope of the synthesized signal.

38. The invention of claim 37, wherein the determining is based on an enable/disable flag generated by an audio encoder that generated the E transmitted channel(s).

39. The invention of claim 37, wherein the determining is based on analyzing the E transmitted channel(s) to detect transients such that the adjusting is enabled if occurrence of a transient is detected.

40. The invention of claim 22, further comprising:

characterizing a temporal envelope of a transmitted channel; and determining whether to use (1) the characterized temporal envelope corresponding to the envelope cue code or (2) the characterized temporal envelope of the transmitted channel to adjust the temporal envelope of the synthesized signal.

41. The invention of claim 22, wherein power within a specified window of the synthesized signal after adjusting the temporal envelope is substantially equal to power within a corresponding window of the synthesized signal before the adjusting.

42. The invention of claim 41, wherein the specified window corresponds to a synthesis window associated with one or more non-envelope cue codes.

43. Apparatus for decoding E transmitted audio channel(s) to generate C playback audio channels, where $C>E\geqq 1$, the apparatus comprising:

means for receiving cue codes corresponding to the E transmitted channel(s), wherein the cue codes comprise an envelope cue code corresponding to a characterized temporal envelope of an audio channel corresponding to the E transmitted channels;

means for upmixing one or more of the E transmitted channels to generate one or more upmixed channels; and means for synthesizing one or more of the C playback channels by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope, wherein:

the cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

44. Apparatus for decoding E transmitted audio channel(s) to generate C playback audio channels, where $C>E\geqq 1$, the apparatus comprising:

a receiver adapted to receive cue codes corresponding to the E transmitted channel(s), wherein the cue codes comprise an envelope cue code corresponding to a characterized temporal envelope of an audio channel corresponding to the E transmitted channels;

an upmixer adapted to upmix one or more of the E transmitted channels to generate one or more upmixed channels; and a synthesizer adapted to synthesize one or more of the C playback channels by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope, wherein:

the cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

45. The invention of claim 44, wherein:

the apparatus is a system selected from the group consisting of a digital video player, a digital audio player, a computer, a satellite receiver, a cable receiver, a terrestrial broadcast receiver, a home entertainment system, and a movie theater system; and the system comprises the receiver, the upmixer, the synthesizer, and the envelope adjuster.

46. A machine-readable storage medium, having encoded thereon program code, wherein, when the program code is executed by a machine, the machine implements a method for decoding E transmitted audio channel(s) to generate C playback audio channels, where $C>E\geqq 1$, the method comprising:

receiving cue codes corresponding to the E transmitted channel(s), wherein the cue codes comprise an envelope cue code corresponding to a characterized temporal envelope of an audio channel corresponding to the E transmitted channel(s);

upmixing one or more of the E transmitted channel(s) to generate one or more upmixed channels; and synthesizing one or more of the C playback channels by applying the cue codes to the one or more upmixed channels, wherein the envelope cue code is applied to an upmixed channel or a synthesized signal to adjust a temporal envelope of the synthesized signal based on the characterized temporal envelope such that the adjusted temporal envelope substantially matches the characterized temporal envelope, wherein:

the cue codes further comprise one or more of inter-channel correlation (ICC) codes, inter-channel level difference (ICLD) codes, and inter-channel time difference (ICTD) codes; and a first time resolution associated with the envelope cue code is finer than a second time resolution associated with the other cue code(s).

* * * * *